US011992865B2

(12) United States Patent
Mercer et al.

(10) Patent No.: US 11,992,865 B2
(45) Date of Patent: May 28, 2024

(54) REFORMER ASSEMBLY

(71) Applicant: Stolle Machinery Company, LLC, Centennial, CO (US)

(72) Inventors: Richard James Edward Mercer, North Yorkshire (GB); Ian Kenneth Scholey, Barnsley (GB)

(73) Assignee: Stolle Machinery Company, LLC, Centennial, CO (US)

( * ) Notice: Subject to any disclaimer, the term of this patent is extended or adjusted under 35 U.S.C. 154(b) by 105 days.

(21) Appl. No.: 17/812,464

(22) Filed: Jul. 14, 2022

(65) Prior Publication Data

US 2022/0339686 A1 Oct. 27, 2022

Related U.S. Application Data

(62) Division of application No. 16/542,378, filed on Aug. 16, 2019.

(51) Int. Cl.
*B21B 35/00* (2006.01)
*B21B 17/00* (2006.01)

(52) U.S. Cl.
CPC ..... *B21B 35/00* (2013.01); *B21B 17/00* (2013.01)

(58) Field of Classification Search
CPC ..... B21B 17/00; B21B 17/14; B21B 35/00; B21D 22/28; B21D 22/30; B21D 51/26; B21D 51/2607; B21D 51/2669
See application file for complete search history.

(56) References Cited

U.S. PATENT DOCUMENTS 5,697,242 A * 12/1997 Halasz ..... B21D 28/30 72/379.4
5,706,686 A * 1/1998 Babbitt ..... B21D 51/26 72/123
6,837,089 B2 * 1/2005 Jentzsch ..... B21D 51/2669 72/110
7,506,779 B2 * 3/2009 Jentzsch ..... B21D 22/14 413/4
2003/0084696 A1 5/2003 Bowlin
2003/0177803 A1 * 9/2003 Golding ..... B21D 22/30 72/94

FOREIGN PATENT DOCUMENTS

KR 101029549 B1 4/2011

OTHER PUBLICATIONS

European Patent Office, EP Application No. 20855330.5, Extended European Search Report, Nov. 16, 2023, 10 pages.
China National Intellectual Property Adminstration (CNIPA), CN Patent Application No. 202080057829.9, Office Action May 7, 2023, 9 pages (and English translation).

* cited by examiner

*Primary Examiner* — Edward T Tolan
(74) *Attorney, Agent, or Firm* — Eckert Seamans Cherin & Mellott, LLC

(57) ABSTRACT

A base reformer assembly, and/or a base reformer roller die unit, includes a generally toroid chuck, a roller die, and a roller die unit actuating assembly. The roller die is movably disposed within the chuck. The roller die unit actuating assembly is structured to actuate the roller die. The roller die unit actuating assembly is operatively coupled to the roller die. Further, all elements of the roller die unit actuating assembly have a robust cross-sectional area.

5 Claims, 21 Drawing Sheets

REFORMER ASSEMBLY

CROSS REFERENCE TO RELATED APPLICATIONS

This application is a divisional application of and claims priority to U.S. patent application Ser. No. 16/542,378, filed Aug. 16, 2019, entitled, REFORMER ASSEMBLY.

FIELD OF THE INVENTION

The disclosed and claimed concept relates to a necker machine and, in particular, to a necker machine including a robust base reformer assembly having a limited number of elements in the base reformer assembly drive assembly.

BACKGROUND OF THE INVENTION

Can bodies are, typically, formed in a bodymaker. That is, a bodymaker forms blanks such as, but not limited to, disks or cups into an elongated can body. A can body includes a base and a depending sidewall. The sidewall is open at the end opposite the base. The bodymaker, typically, includes a ram/punch that moves the blanks through a number of dies to form the can body. After forming, the can body base includes a concave dome extending into the enclosed space defined by the can body. The can body is ejected from the ram/punch for further processing such as, but not limited to, trimming, washing, printing, flanging, inspecting, and placed on pallets which are shipped to the filler. At the filler, the cans are taken off of the pallets, filled, have can ends coupled to them and then the filled cans are repackaged in six packs and/or twelve pack cases, etc.

Can bodies are, typically, formed in a bodymaker. That is, a bodymaker forms blanks such as, but not limited to, disks or cups into an elongated can body. A can body includes a base and a depending sidewall. The sidewall is open at the end opposite the base. The bodymaker, typically, includes a ram/punch that moves the blanks through a number of dies to form the can body. After forming, the can body base includes a concave dome extending into the enclosed space defined by the can body. The can body is ejected from the ram/punch for further processing such as, but not limited to, trimming, washing, printing, flanging, inspecting, and placed on pallets which are shipped to the filler. At the filler, the cans are taken off of the pallets, filled, have can ends coupled to them and then the filled cans are repackaged in six packs and/or twelve pack cases, etc.

Some can bodies are further formed in a necker machine. Necker machines are structured to reduce the diameter/radius of the can body at the open end. That is, the open end is reduced relative to the diameter/radius of other portions of the can body sidewall. Typically, a necker machine processes over 3000 can bodies per minute. The necker machine includes a number of processing and/or forming stations disposed in series. Further, each forming station processes multiple can bodies at a time. In an exemplary embodiment, a forming station includes twelve forming units. When a can body is disposed at a forming unit, that forming unit moves over a path while forming the can body. The forming unit then ejects the can body and is moved back to the initial position to receive another can body. It is understood that the other units at the forming station follow the same path and operate in a similar manner. Thus, at such a station, there are a number of can bodies at different stages of the forming being performed with a more limited number of forming units receiving/ejecting a can body or moving to a position to receive another can body.

Further, the processing and/or forming stations are disposed adjacent to each other and a transfer assembly moves a can body between adjacent processing and/or forming stations. As the can bodies move through the necker machine, the can bodies stay, generally, in the same plane. That is, when viewed from the front side of the necker machine, the can body moves, for example, left to right while remaining within the same general plane. This configuration allows the use of "starwheels" to move the can body between forming stations rapidly and without the need to move the can bodies in/out of the general plane of motion. That is, this configuration allows for a simplified transfer assembly.

This configuration, however, also means that the forming assemblies need to operate in a limited space or plane. This, in turn, means that the forming assemblies have a limited space in which the forming elements are disposed. That is, generally, the forming assembly is disposed between the front of the necker machine (or the drive assembly) and the plane in which the can bodies move. Typically, this space is about 18 inches between the front of the necker machine and the plane in which the can bodies move. Thus, each forming assembly has a limited length in a direction generally perpendicular to the plane in which the can bodies move. This configuration leads to known problems.

That is, the forming assemblies must be configured with the forming elements and the drive elements substantially within the limited length/space allowed as described above. This, in turn, means that many of the forming/drive elements are smaller than would be desired. That is, when forming 3000 can bodies per minute, the forming/drive elements are subject to wear. Thus, it is generally desirable to have large and robust elements but, due to the limited space, these elements are often smaller than desired. Thus, these elements often need maintenance or need to be replaced. This is a problem.

For example, one station of the necker machine is, typically, a base reformer. The base reformer station utilizes a die to reform, i.e., reshape, the shape of the can body base. As is known, the bodymaker, discussed above, forms a can body with an inwardly domed portion having an annular ring disposed thereabout. The base reformer station reforms the annular ring by modifying the internal base profile of a can body in order to allow an increase in body strength at the base. This allows lower gauge thicknesses to be used for the can body resulting in a reduction in metal usage. In the prior art, the base reformer included a roller die that was configured to fit within the space defined by the can body dome. A can body is transferred to a base reformer unit when the forming die, hereinafter "the reforming die," is disposed at a generally central location relative to the base. The reforming die has a smaller cross-sectional area than the dome; thus, the reforming die was disposed within, and did not contact, the can body base. As the base reformer unit moved over its path, as described above, the reforming die moved radially outwardly to contact and reform the can body base. After the base reformer unit reformed the base, the reforming die returned to a central position and the can was ejected and moved on to a subsequent forming station.

Various drive assemblies were included in each base reformer unit. For example, a cam actuated drive assembly moved the reforming die radially from the central location to engagement with the can body base. Then, a drive system utilizing gears was used to rotate the reforming die about the can body base. Given the space available for such a drive assembly, the gears, and especially the teeth of the gears, are examples of elements having a size prone to wear. That is, such drive assembly elements, as well as other elements, are the types of elements that need frequent maintenance and replacement. Such elements are a problem.

Further, given the limited space for the base reformer unit, such units do not include certain desirable elements/assemblies. For example, the reforming die is positioned and maintained in a selected plane by bushings. That is, at a location offset from the forming portion of the reforming die, i.e., the portion that contacts the can body base, the reforming die included an outwardly extending flange. This flange was disposed between two substantially parallel toroid bushings. In some embodiments, the friction between the reforming die and the bushings was further reduced by a lubricant, e.g., grease. The bushings, however, were exposed to the industrial atmosphere when a can body was not disposed on the base reformer unit. Thus, the bushing and/or the lubricant was exposed to contamination. This is a problem. Moreover, constructs such as, but not limited to, sealed thrust bearings were not used in place of such bushings because of the limited available space, as described above. This is also a problem.

It is noted that the reforming die, which was typically a generally cylindrical roller die, had a radius that was much smaller than the dome radius. As such, the reforming die did not trap, or otherwise interfere, with movement of the can body following base reformation. As such, the known base reformer assemblies did not require additional construct to assist when moving the can body from the base reformer assembly. As discussed below, when the reforming die has a larger radius, i.e., a radius that is smaller than, but nearly the same size as, the dome radius, there is a potential for interference between the reforming die and can body. That is, the can body has the potential to become loosely trapped between the reforming die and the chuck. This is a problem. That is, the lack of a can body ejection system at the base reformer assembly is a problem.

There is, therefore, a need for a base reformer assembly, and/or a base reformer roller die unit, that has a robust cross-sectional area. There is a further need for a base reformer assembly, and/or a base reformer roller die unit, that does not include gears. There is a further need for a base reformer assembly, and/or a base reformer roller die unit, that includes friction reducing devices with sealed friction reducing elements. There is a further need for a base reformer assembly, and/or a base reformer roller die unit, that includes a can body ejection system to assist with ejecting the can body from the base reformer assembly. Some can bodies are further formed in a necker machine. Necker machines are structured to reduce the diameter/radius of the can body at the open end. That is, the open end is reduced relative to the diameter/radius of other portions of the can body sidewall. Typically, a necker machine processes over 3000 can bodies per minute. The necker machine includes a number of processing and/or forming stations disposed in series. Further, each forming station processes multiple can bodies at a time. In an exemplary embodiment, a forming station includes twelve forming units. When a can body is disposed at a forming unit, that forming unit moves over a path while forming the can body. The forming unit then ejects the can body and is moved back to the initial position to receive another can body. It is understood that the other units at the forming station follow the same path and operate in a similar manner. Thus, at such a station, there are a number of can bodies at different stages of the forming being performed with a more limited number of forming units receiving/ejecting a can body or moving to a position to receive another can body.

Further, the processing and/or forming stations are disposed adjacent to each other and a transfer assembly moves a can body between adjacent processing and/or forming stations. As the can bodies move through the necker machine, the can bodies stay, generally, in the same plane. That is, when viewed from the front side of the necker machine, the can body moves, for example, left to right while remaining within the same general plane. This configuration allows the use of "starwheels" to move the can body between forming stations rapidly and without the need to move the can bodies in/out of the general plane of motion. That is, this configuration allows for a simplified transfer assembly.

This configuration, however, also means that the forming assemblies need to operate in a limited space or plane. This, in turn, means that the forming assemblies have a limited space in which the forming elements are disposed. That is, generally, the forming assembly is disposed between the front of the necker machine (or the drive assembly) and the plane in which the can bodies move. Typically, this space is about 18 inches between the front of the necker machine and the plane in which the can bodies move. Thus, each forming assembly has a limited length in a direction generally perpendicular to the plane in which the can bodies move. This configuration leads to known problems.

That is, the forming assemblies must be configured with the forming elements and the drive elements substantially within the limited length/space allowed as described above. This, in turn, means that many of the forming/drive elements are smaller than would be desired. That is, when forming 3000 can bodies per minute, the forming/drive elements are subject to wear. Thus, it is generally desirable to have large and robust elements but, due to the limited space, these elements are often smaller than desired. Thus, these elements often need maintenance or need to be replaced. This is a problem.

For example, one station of the necker machine is, typically, a base reformer. The base reformer station utilizes a die to reform, i.e., reshape, the shape of the can body base. As is known, the bodymaker, discussed above, forms a can body with an inwardly domed portion having an annular ring disposed thereabout. The base reformer station reforms the annular ring by modifying the internal base profile of a can body in order to allow an increase in body strength at the base. This allows lower gauge thicknesses to be used for the can body resulting in a reduction in metal usage. In the prior art, the base reformer included a roller die that was configured to fit within the space defined by the can body dome. A can body is transferred to a base reformer unit when the forming die, hereinafter "the reforming die," is disposed at a generally central location relative to the base. The reforming die has a smaller cross-sectional area than the dome; thus, the reforming die was disposed within, and did not contact, the can body base. As the base reformer unit moved over its path, as described above, the reforming die moved radially outwardly to contact and reform the can body base. After the base reformer unit reformed the base, the reforming die returned to a central position and the can was ejected and moved on to a subsequent forming station.

Various drive assemblies were included in each base reformer unit. For example, a cam actuated drive assembly moved the reforming die radially from the central location to engagement with the can body base. Then, a drive system utilizing gears was used to rotate the reforming die about the can body base. Given the space available for such a drive assembly, the gears, and especially the teeth of the gears, are examples of elements having a size prone to wear. That is, such drive assembly elements, as well as other elements, are the types of elements that need frequent maintenance and replacement. Such elements are a problem.

Further, given the limited space for the base reformer unit, such units do not include certain desirable elements/assemblies. For example, the reforming die is positioned and maintained in a selected plane by bushings. That is, at a location offset from the forming portion of the reforming die, i.e., the portion that contacts the can body base, the reforming die included an outwardly extending flange. This flange was disposed between two substantially parallel toroid bushings. In some embodiments, the friction between the reforming die and the bushings was further reduced by a lubricant, e.g., grease. The bushings, however, were exposed to the industrial atmosphere when a can body was not disposed on the base reformer unit. Thus, the bushing and/or the lubricant was exposed to contamination. This is a problem. Moreover, constructs such as, but not limited to, sealed thrust bearings were not used in place of such bushings because of the limited available space, as described above. This is also a problem.

It is noted that the reforming die, which was typically a generally cylindrical roller die, had a radius that was much smaller than the dome radius. As such, the reforming die did not trap, or otherwise interfere, with movement of the can body following base reformation. As such, the known base reformer assemblies did not require additional construct to assist when moving the can body from the base reformer assembly. As discussed below, when the reforming die has a larger radius, i.e., a radius that is smaller than, but nearly the same size as, the dome radius, there is a potential for interference between the reforming die and can body. That is, the can body has the potential to become loosely trapped between the reforming die and the chuck. This is a problem. That is, the lack of a can body ejection system at the base reformer assembly is a problem.

There is, therefore, a need for a base reformer assembly, and/or a base reformer roller die unit, that has a robust cross-sectional area. There is a further need for a base reformer assembly, and/or a base reformer roller die unit, that does not include gears. There is a further need for a base reformer assembly, and/or a base reformer roller die unit, that includes friction reducing devices with sealed friction reducing elements. There is a further need for a base reformer assembly, and/or a base reformer roller die unit, that includes a can body ejection system to assist with ejecting the can body from the base reformer assembly.

SUMMARY OF THE INVENTION

These needs, and others, are met by at least one embodiment of this invention which provides a base reformer assembly, and/or a base reformer roller die unit, including a generally toroid chuck, a roller die, and a roller die unit actuating assembly. The roller die is movably disposed within the chuck. The roller die unit actuating assembly is structured to actuate the roller die. The roller die unit actuating assembly is operatively coupled to the roller die. Further, all elements of the roller die unit actuating assembly have a robust cross-sectional area. This solves the problem(s) noted above.

Further, or in an alternate embodiment, the roller die unit actuating assembly does not include any gears. This solves the problem(s) noted above. Further, or in an alternate embodiment, the roller die unit actuating assembly is a cam actuated actuating assembly. This solves the problem(s) noted above. Further, or in an alternate embodiment, the roller die unit actuating assembly includes a friction reducing device with sealed friction reducing elements. This solves the problem(s) noted above. Further, or in an alternate embodiment, the base reformer assembly, and/or a base reformer roller die unit, includes a can body ejection system. This solves the problem(s) noted above.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
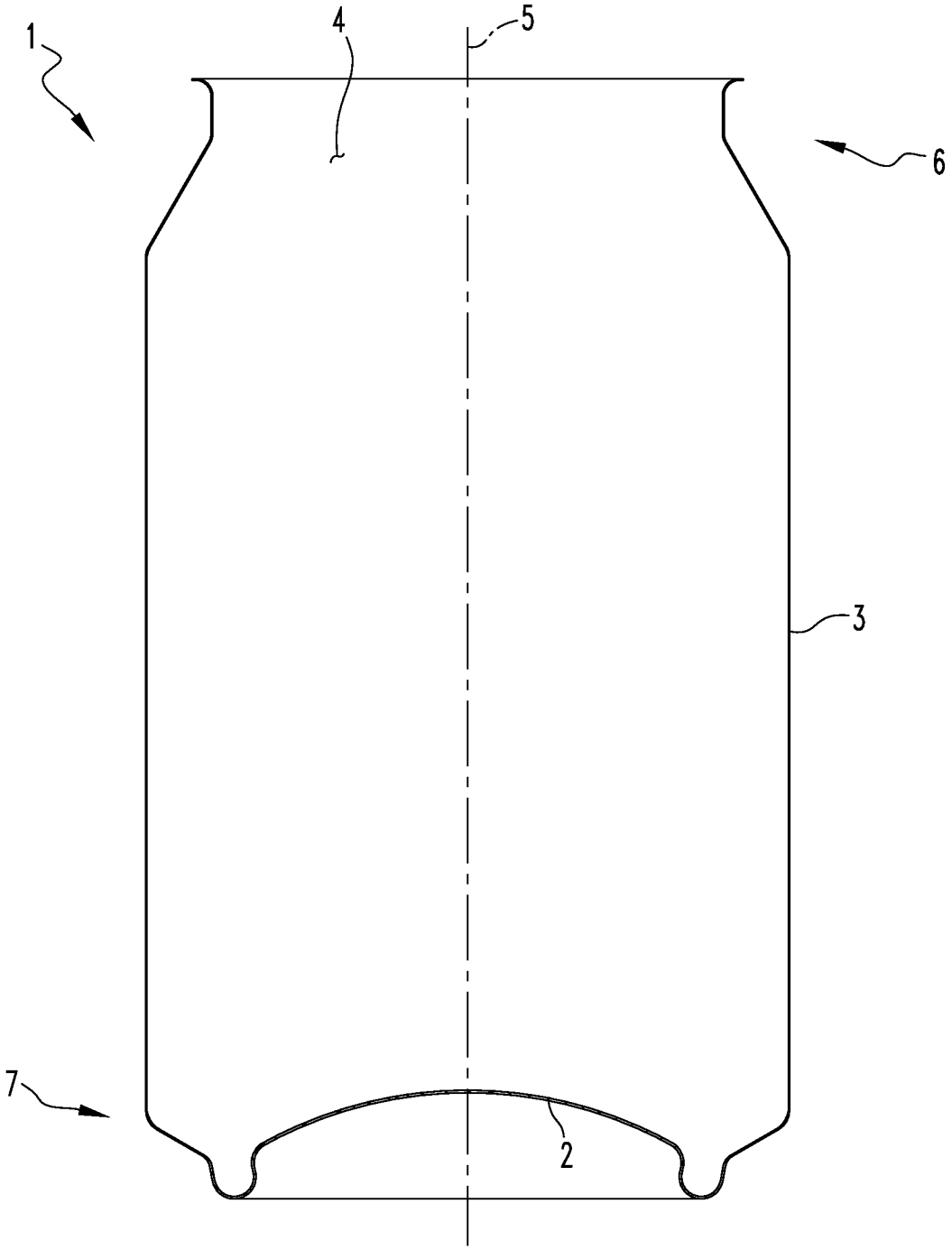
FIG. 1 is a schematic cross-sectional view of a can body.
Figure 2:
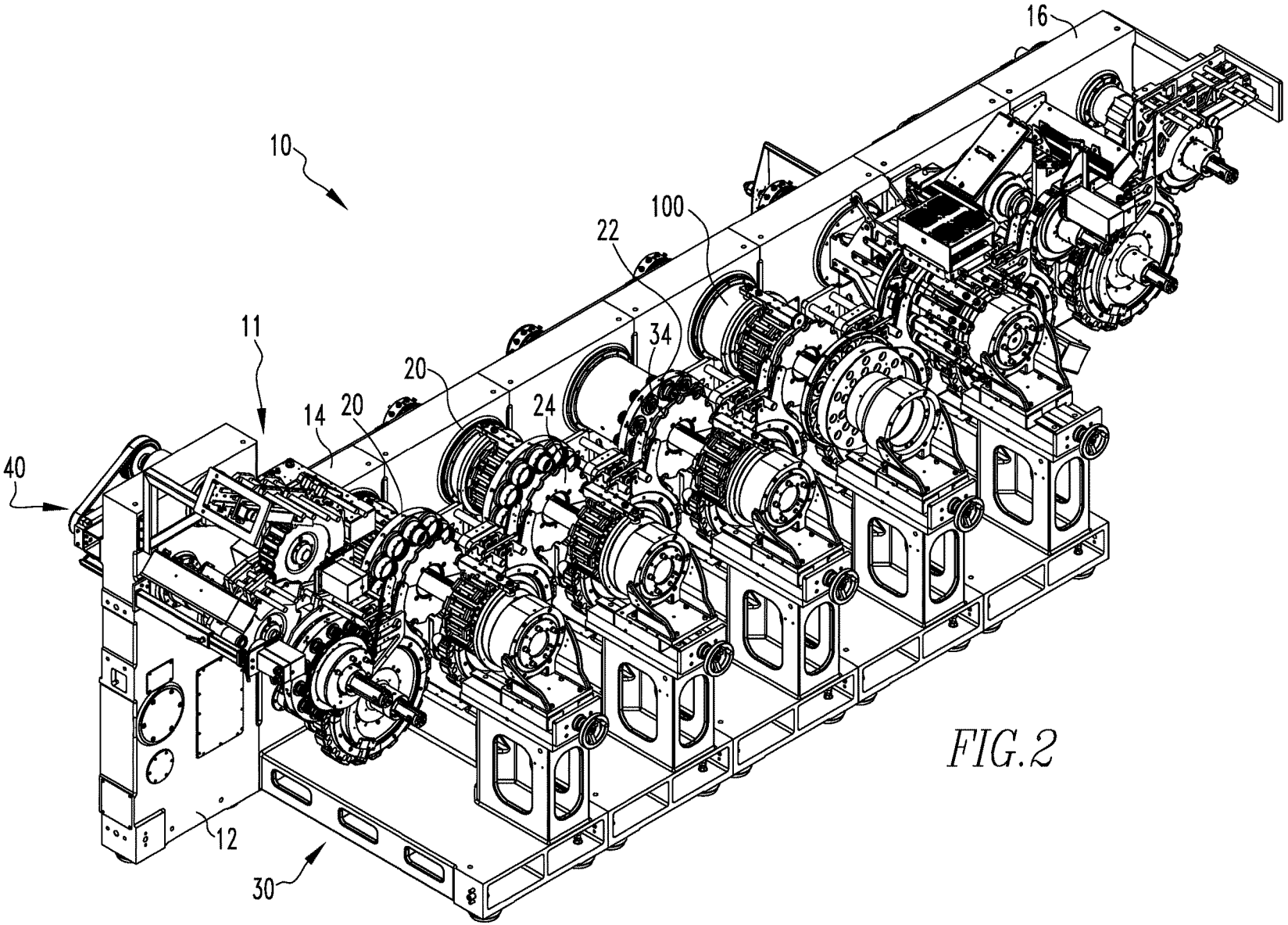
FIG. 2 is an isometric view of a necker machine.
Figure 3:
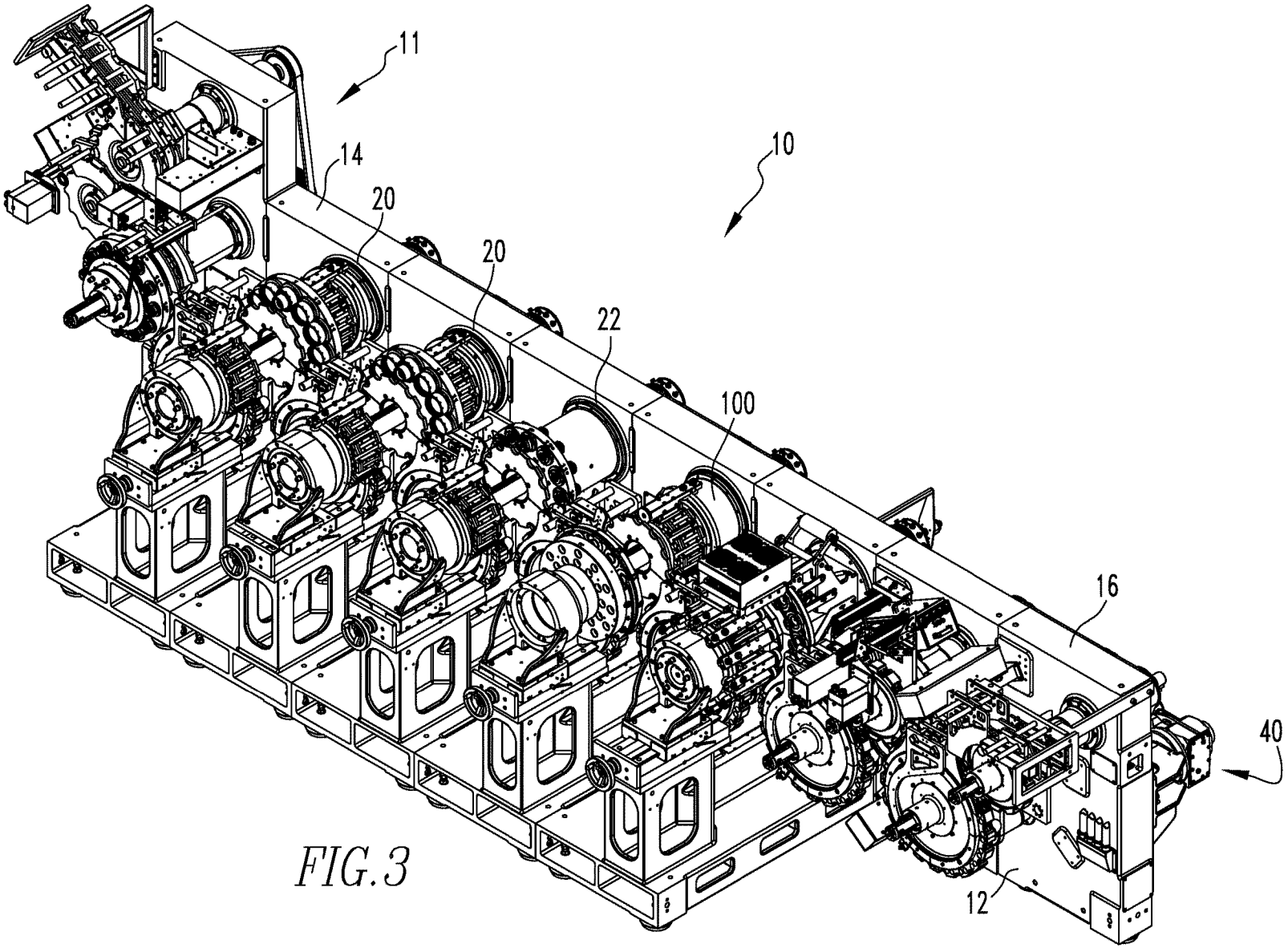
FIG. 3 is another isometric view of a necker machine.
Figure 4:
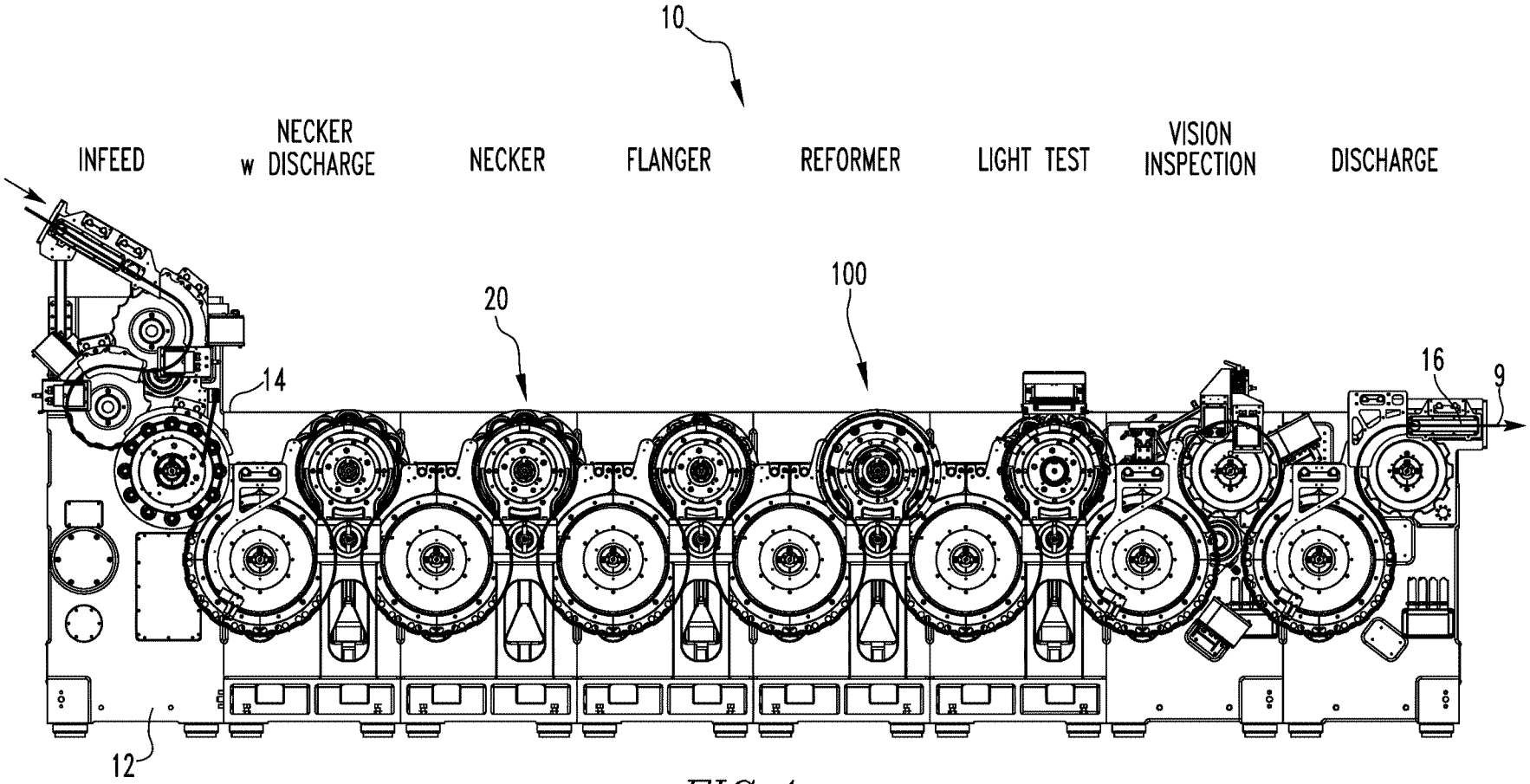
FIG. 4 is a front view of a necker machine.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut or threaded bore. Further, a passage in an element is part of the "coupling" or "coupling component(s)." For example, in an assembly of two wooden boards coupled together by a nut and a bolt extending through passages in both boards, the nut, the bolt and the two passages are each a "coupling" or "coupling component."

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. As used herein, "adjustably fixed" means that two components are coupled so as to move as one while maintaining a constant general orientation or position relative to each other while being able to move in a limited range or about a single axis. For example, a doorknob is "adjustably fixed" to a door in that the doorknob is rotatable, but generally the doorknob remains in a single position relative to the door. Further, a cartridge (nib and ink reservoir) in a retractable pen is "adjustably fixed" relative to the housing in that the cartridge moves between a retracted and extended position, but generally maintains its orientation relative to the housing. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, "functionally coupled" means that a number of elements or assemblies are coupled together so that a characteristic and/or function of one element/assembly is communicated or useable by the other element/assembly. For example, a characteristic of an extension cord is the ability to communicate electricity. When two extension cords are "functionally coupled," the two extension cords are coupled so that electricity is communicable through both extension cords. As another example, two wireless routers, which have the characteristic of communicating data, are "functionally coupled" when the two routers are in communication with each other (but not physically coupled to each other) so that data is communicable through both routers.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, "temporarily disposed" means that a first element(s) or assembly(ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve, as a whole, moves relative to the body of the automobile.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). That is, for example, the phrase "a number of elements" means one element or a plurality of elements. It is specifically noted that the term "a 'number' of [X]" includes a single [X].

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center of the cylinder. That is, generally, for a cylindrical soup can, the "radial side/surface" is the generally circular sidewall and the "axial side(s)/surface(s)" are the top and bottom of the soup can. Further, as used herein, "radially extending" means extending in a radial direction or along a radial line. That is, for example, a "radially extending" line extends from the center of the circle or cylinder toward the radial side/surface. Further, as used herein, "axially extending" means extending in the axial direction or along an axial line. That is, for example, an "axially extending" line extends from the bottom of a cylinder toward the top of the cylinder and substantially parallel to a central longitudinal axis of the cylinder.

As used herein, "generally curvilinear" includes elements having multiple curved portions, combinations of curved portions and planar portions, and a plurality of planar portions or segments disposed at angles relative to each other thereby forming a curve.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces. The perimeter, and therefore the edge surface, may include generally straight portions, e.g., as on a rectangular planar member, or be curved, as on a disk, or have any other shape.

As used herein, for any adjacent ranges that share a limit, e.g., 0%-5% and 5%-10, or, 0.05 inch-0.10 inch and 0.001 inch-0.05 inch, the upper limit of the lower range, i.e., 5% and 0.05 inch in the lower range of the examples above, means slightly less than the identified limit. That is, in the example above, the range 0%-5% means 0%-4.999999% and the range 0.001 inch-0.05 inch means 0.001 inch-0.04999999 inch.

As used herein, "upwardly depending" means an element that extends upwardly and generally perpendicular from another element.

As used herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and beverage cans, as well as food cans.

As used herein, a "can body" includes a base and a depending, or upwardly depending, sidewall. The "can body" is unitary. In this configuration, the "can body" defines a generally enclosed space. Thus, the "can body," i.e., the base and sidewall, also include(s) an outer surface and an inner surface. That is, for example, a "can body" includes a sidewall inner surface and a sidewall outer surface.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, an "elongated" element inherently includes a longitudinal axis and/or longitudinal line extending in the direction of the elongation.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and/or near relevant to the term being modified as would be understood by one of ordinary skill in the art.

As used herein, to "form" metal means to change the shape of a metal construct.

As used herein, a "forming distance" is a distance between two dies that is sufficiently narrow than at least a portion of the die(s) contacts and forms the material between the dies.

A moving die that engages metal moves over a "path" as defined above. When the die path causes the die to form, i.e., change the shape/contour of, the metal, the path is, as used herein, a "forming path." An "ironing path" is a specific type of "forming path." That is, when the die path causes the die to smooth the surface of the metal but does not otherwise change the shape/contour of, the metal, the path is, as used herein, an "ironing path."

As used herein, a "robust" cross-section, or cross-sectional area, of an element other than a coupling component such as, but not limited to, a bolt, means a cross-section, or cross-sectional area, that is larger than a "small" cross-section, or cross-sectional area. As used herein, a "small" cross-section, or cross-sectional area, means a cross-section, or cross-sectional area, that is less than 0.1699999 in.$^2$ Further, as used herein with respect to the term "robust," a "cross-sectional area" is measured in a plane that is generally perpendicular, or normal, to a surface of an element and through the center of the element. Thus, it is understood that an element, other than a spherical element, has more than one "cross-sectional area." If any "cross-sectional area" of an element is less than 0.1699999 in.$^2$, then the element does not have a "robust" cross-sectional area as used herein. Further, an "element" means a whole and identifiable construct. For example, a spur gear has a generally cylindrical wheel, or disk-like body, with teeth disposed about the perimeter. (See, *Merriam-Webster Online Dictionary* wherein a "spur gear" is defined as "a gear wheel with radial teeth," https://www.merriam-webster.com/dictionary/spur%20gear). Thus, the wheel/body and the teeth are the identifiable constructs of a spur gear. Conversely, the "tip of a tooth" on a spur gear is not a "whole" identifiable construct. That is, if an item is identified as portion of another element, it is not a "whole" identifiable construct.

As used herein, "all elements of the roller die unit actuating assembly" means all elements with the exception of coupling components such as, but not limited to, a bolt, a nut, a pivot pin, or an axle. That is, as described below, and in one embodiment, a roller die unit actuating assembly 250 includes a parallel linkage 252 which is an assembly including a proximal, first link member 260, a distal, second link member 280, a cam follower assembly 300, and a number of coupling components/pivot pins (not numbered). Thus, for this embodiment, "all elements of the roller die unit actuating assembly" means the first link member 260, the second link member 280 and the cam follower assembly 300, but does not include the coupling components/pivot pins. It is understood that in an embodiment with other, or additional, elements the term "all elements of the roller die unit actuating assembly" means all elements with the exception of coupling components.

As used herein, a "cam actuated actuating assembly" means an actuating assembly wherein all motion is generated and/or caused by the interaction of a number of cams and cam followers.

As used herein, a "friction reducing device" is a unitary construct or an assembly structured to reduce friction between two or more other elements. "Friction reducing devices" include, but are not limited to, bushings and bearing assemblies. "Friction reducing device" does not mean a lubricant by itself. That is, certain bearing assemblies include a lubricant and such a bearing assembly is a "friction reducing device." Further, as used herein, all "friction reducing devices" include a "friction reducing element(s)." For example, the surface of a bushing disposed against a moving element is a "friction reducing element." Further, the balls and/or lubricant in a toroid ball bearing assembly are "friction reducing elements." As used herein, a "sealed" friction reducing device is a friction reducing device wherein the friction reducing element(s) are not generally exposed to the atmosphere. That is, a non-"sealed" toroid ball bearing assembly includes a first race, a second race and ball bearings. The ball bearings are disposed between the first race and second race. Further, a gap exists between the first race and the second race. Thus, the ball bearings, i.e., the "friction reducing elements" are exposed to the atmosphere. In a sealed ball bearing assembly, a seal or similar construct fills the gap between the first race and the second race. Thus, the ball bearings, i.e., the "friction reducing elements" are not exposed to the atmosphere. As used herein, and with respect to the definition of "sealed," the term "not generally exposed to the atmosphere" does not mean an airtight or hermetic seal, but rather a seal that prevents the passage of solids such as, but not limited to dust and particulate matter.

As used herein, a "parallel linkage" means a linkage that includes a plurality of linkage members and pivot elements and which is structured to move a forming die generally in a plane. Further, the linkage members move generally in the plane of the die motion and/or in a plane generally parallel to the plane of the die motion. As used herein, a "linkage member" means an element that pivots and/or which defines a pivot. As used herein, a "pivot element" means an element that defines an axis of rotation for a linkage member and includes, but is not limited to, pivot pins. A "pivot element" is not a "linkage member."

As used herein, a "pivot" coupling means a rotational coupling wherein the elements coupled by the "pivot" coupling rotate less than 360°. Similarly, as used herein, to be "pivotably" coupled means to be rotationally coupled but wherein the range of motion of the elements "pivotably" coupled is less than 360°. That is, a "pivot" coupling is a rotational coupling but the elements coupled thereto have a limited range of motion. Thus, the nature of the coupling is determined by the elements coupled thereto and not by the coupling itself.

As used herein, a "cam channel" means a groove, or similar construct, wherein at least one surface defining the channel is structured to be a cam surface. As used herein, a "side cam channel" means "cam channel" wherein a surface defining a side (or side portion) of the channel, as opposed to the bottom surface (or bottom portion) of the channel, is structured to be a cam surface. As used herein, a "dual-side cam channel" means a "cam channel" including generally opposed and generally parallel sides and wherein both sides of the "cam channel" are structured to be a cam surface.

As used herein, a "dual-level" cam channel means a "dual-side cam channel" wherein one side of the cam channel defines a first cam surface that moves a cam follower in one direction and the other side of the cam channel defines a second cam surface that moves a cam follower in the other direction. For example, if the cam channel is generally straight, the first cam surface moves a cam follower laterally to the right and the second cam surface moves a cam follower laterally to the left. Alternatively, if the cam channel is generally circular, the first cam surface moves a cam follower radially outwardly and the second cam surface moves a cam follower radially inwardly. Further, as used herein, in a "dual-level" cam channel the first cam surface is at a first elevation relative to the cam channel bottom surface and the second cam surface is at a second elevation relative to the cam channel bottom surface. Further, in this configuration, the surface opposite the first cam surface and the surface opposite the second cam surface do not affect the cam follower and, as such, are structured to be spaced from a cam follower that engages the first/second cam surface. Alternatively, the surface opposite the first cam surface and the surface opposite the second cam surface are absent. The lack of a surface opposite a first/second cam surface in a "dual-level" cam channel does not change the nature of the channel as a "dual-side cam channel." That is, there are still two opposed cam surfaces but the cam surfaces are at different elevations relative to each other. As used herein, and with respect to a cam surface of a cam channel, "elevation" is the distance relative to the cam channel bottom surface.

As used herein, "cooperative cam channels" means a plurality of cam channels structured to interact with a linkage having at least two elongated linkage members, a plurality of cam followers wherein the interaction between the cam channels, the cam followers, and the linkage move a portion of a linkage member over a selected, i.e., an intended, path. As used herein, a "portion of a linkage member" means an identifiable portion such as, but not limited to, an end of the linkage member. Further, as used herein, the "portion of a linkage member" that moves over the selected path is also identified as the "actuated element." Thus, as used herein, all "cooperative cam channels" inherently have a number of associated "actuated element(s)." As used herein, "circular cooperative cam channels" means "cooperative cam channels" that move a portion of a linkage member over a generally circular path. As used herein, "spiral/circular cooperative cam channels" means "cooperative cam channels" that move a portion of a linkage member over a path that initially spirals outwardly from an origin to a selected radius, follows a circular path for at least one revolution, then spirals inwardly to the origin. As used herein, "[X] circular cooperative cam channels" or "[X] spiral/circular cooperative cam channels" means "circular cooperative cam channels" or "spiral/circular cooperative cam channels" that move a portion of a linkage member over a path including about [X] number of circular revolutions. It is understood that [X] is a term indicating a number such as, but not limited to, "single," "double," "triple," etc. That is, for example, the term "triple spiral/circular cooperative cam channels" means "cooperative cam channels" that move a portion of a linkage member over a path that initially spirals outwardly to a selected radius, follows a circular path for about three revolutions, then spirals toward the origin. Thus, the spiral portion of the path does not count as a revolution. Further, the [X] does not identify the number of "cooperative cam channels." That is, the term "triple spiral/circular cooperative cam channels" does not mean that there are three "cooperative cam channels."

The following discussion uses multiple adjectives and/or noun adjuncts to describe various elements. For example, the full name of one element discussed below is "base reformer unit roller die friction reducing device roller bearing assembly 200." As used herein, the full name of an element may be reduced by removing one or more of the adjectives and/or noun adjuncts. Thus, as used herein, a "base reformer unit roller die friction reducing device roller bearing assembly 200" may also be identified as a "roller die friction reducing device roller bearing assembly 200." That is, the initial noun adjunct "base reformer unit" has been removed. This nomenclature applies to all elements identified by adjectives and/or noun adjuncts.

As shown in FIGS. 1-4, a necker machine 10 is structured to reduce the diameter of a portion of a can body 1. As used herein, to "neck" means to reduce the diameter/radius of a portion of a can body 1. That is, a can body 1 includes a base 2 with an upwardly depending sidewall 3. The can body base 2 and can body sidewall 3 define a generally enclosed space 4. In the embodiment discussed below, the can body 1 is a generally circular and/or an elongated cylinder. It is understood that this is only one exemplary shape and that the can body 1 may have other shapes. The can body has a longitudinal axis 5. The can body sidewall 3 has a first end 6 and a second end 7. The can body base 2 is at the second end 7. The can body first end 6 is open. The can body first end 6 initially has substantially the same radius/diameter as the can body sidewall 3. Following forming operations in the necker machine 10, the radius/diameter of the can body first end 6 is smaller than the other portions of the radius/diameter as the can body sidewall 3.

The necker machine 10 includes an infeed assembly 11, a plurality of processing/forming stations 20, a transfer assembly 30, and a drive assembly 40. Hereinafter, processing/forming stations 20 are identified by the term "processing stations 20" and refer to generic processing stations 20. Specific processing stations, which are included in the collective group of "processing stations 20," are discussed below and are given a separate reference number. Each processing station 20 has a width which is generally the same as all other processing stations 20. Thus, the length/space occupied by the necker machine 10 is determined by the number of processing stations 20.

As is known, the processing stations 20 are disposed adjacent to each other and in series. That is, the can bodies 1 being processed by the necker machine 10 each move from an upstream location through a series of processing stations 20 in the same sequence. The can bodies 1 follow a path, hereinafter, the "work path 9." That is, the necker machine 10 defines the work path 9 wherein can bodies 1 move from an "upstream" location to a "downstream" location; as used herein, "upstream" generally means closer to the necker machine infeed assembly 11 and "downstream" means closer to an exit assembly (not numbered). With regard to elements that define the work path 9, each of those elements have an "upstream" end and a "downstream end" wherein the can bodies move from the "upstream" end to the "downstream end." Thus, as used herein, the nature/identification of an element, assembly, sub-assembly, etc. as an "upstream" or "downstream" element or assembly, or, being in an "upstream" or "downstream" location, is inherent. Further, as used herein, the nature/identification of an element, assembly, sub-assembly, etc. as an "upstream" or "downstream" element or assembly, or, being in an "upstream" or "downstream" location, is a relative term.

As noted above, each processing station 20 has a similar width and the can body 1 is processed and/or formed (or partially formed) as the can body 1 moves across the width. Generally, the processing/forming occurs in/at a turret 22. That is, the term "turret 22" identifies a generic turret. As discussed below, each processing station 20 includes a non-vacuum starwheel 24. As used herein, a "non-vacuum starwheel" means a starwheel that does not include, or is not associated with, a vacuum assembly that is structured to apply a vacuum to the starwheel pockets 34, discussed below. Further, each processing station 20 typically includes one turret 22 and one non-vacuum starwheel 24 or another support for the can bodies 1. The transfer assembly 30 is structured to move the can bodies 1 between adjacent processing stations 20.

To accomplish this, the necker machine 10 includes a frame assembly 12 to which the plurality of processing stations 20 are removably coupled. Alternatively, the frame assembly 12 includes elements incorporated into each of the plurality of processing stations 20 so that the plurality of processing stations 20 are structured to be temporarily coupled to each other. The frame assembly 12 has an upstream end 14 and a downstream end 16. Further, the frame assembly 12 includes elongated members, panel members (neither numbered), or a combination of both. As is known, panel members coupled to each other, or coupled to elongated members, form a housing. Accordingly, as used herein, a housing is also identified as a "frame assembly 12."

The specific nature of the processing stations 20 upstream or downstream of a base reformer station 100 are not relevant to the present disclosure. It is understood that the transfer assembly 30 feeds a series of can bodies 1, one at a time, to the base reformer station 100. The base reformer station 100 is structured to, and does, form the can body base 2 and, in an exemplary embodiment, the can body sidewall 3 adjacent the can body base 2.

Figure 5:
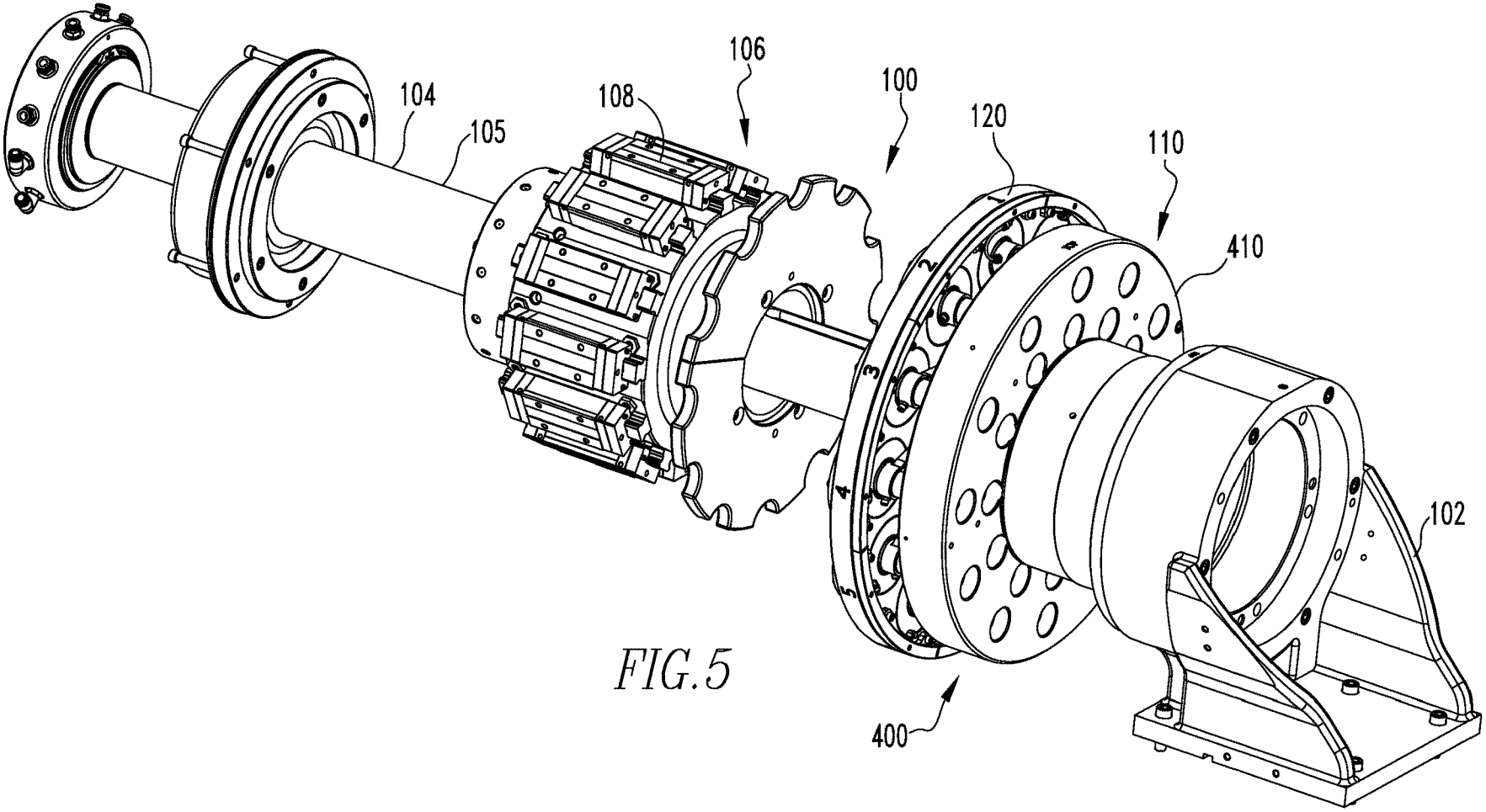
FIG. 5 is a partial isometric view of a base reformer station.
Figure 6:
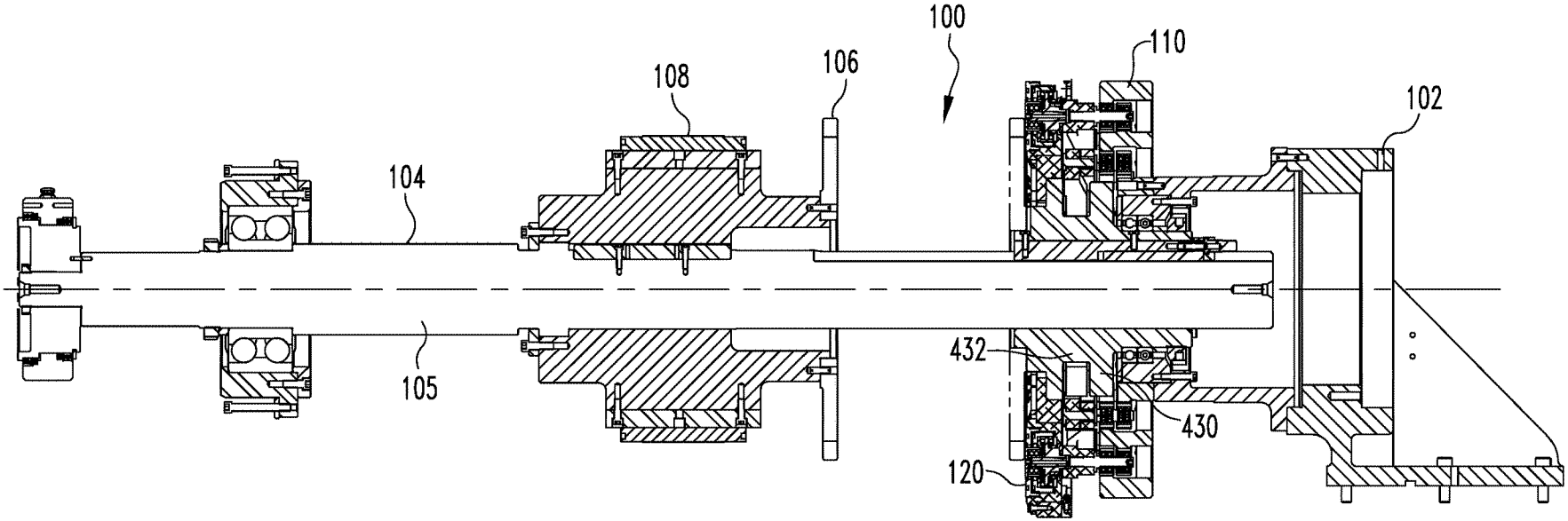
FIG. 6 is a partial cross-sectional side view of a base reformer station.
Figure 7:
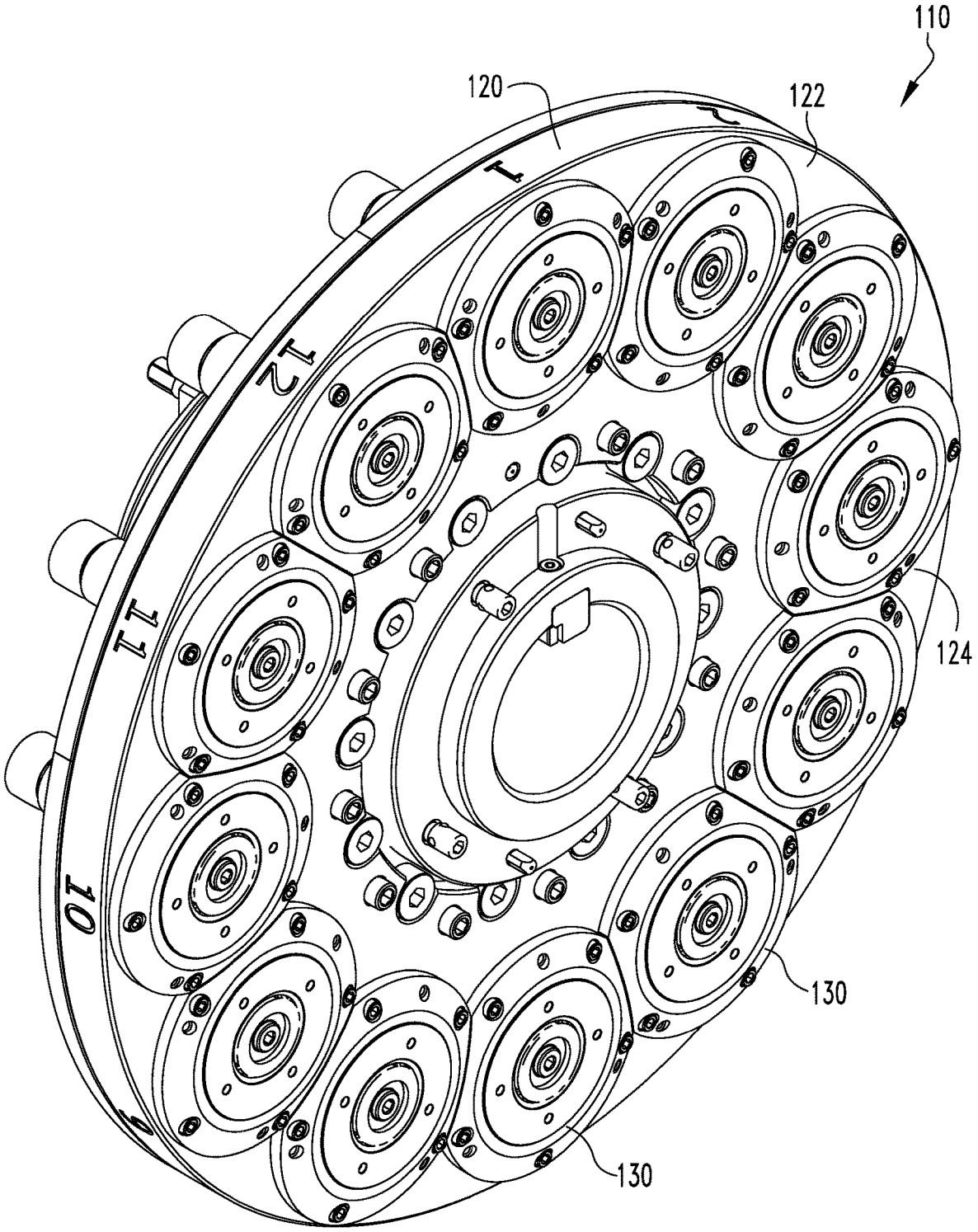
FIG. 7 is an isometric view of a base reformer assembly.
Figure 8:
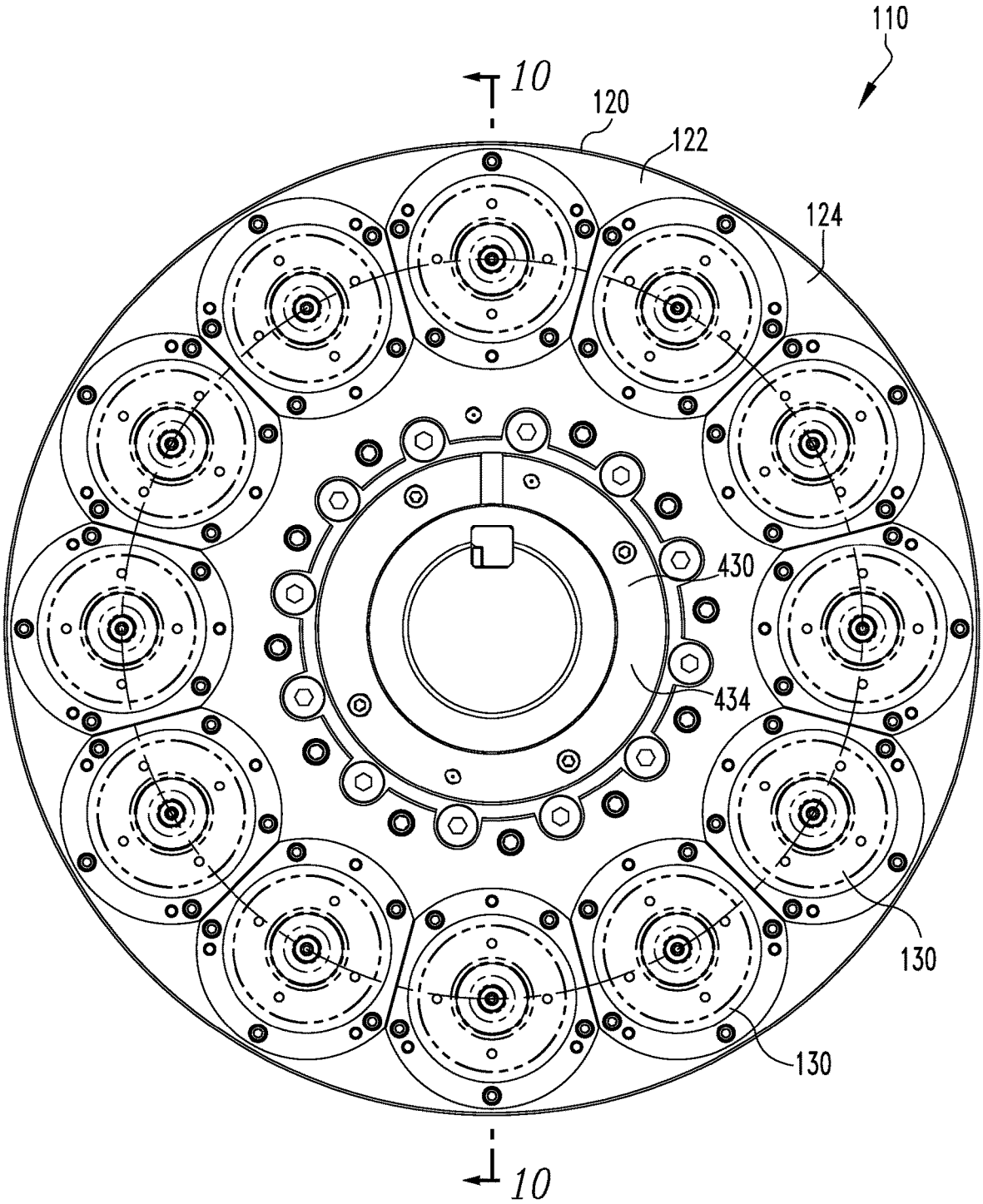
FIG. 8 is a front view of a base reformer assembly.
Figure 9:
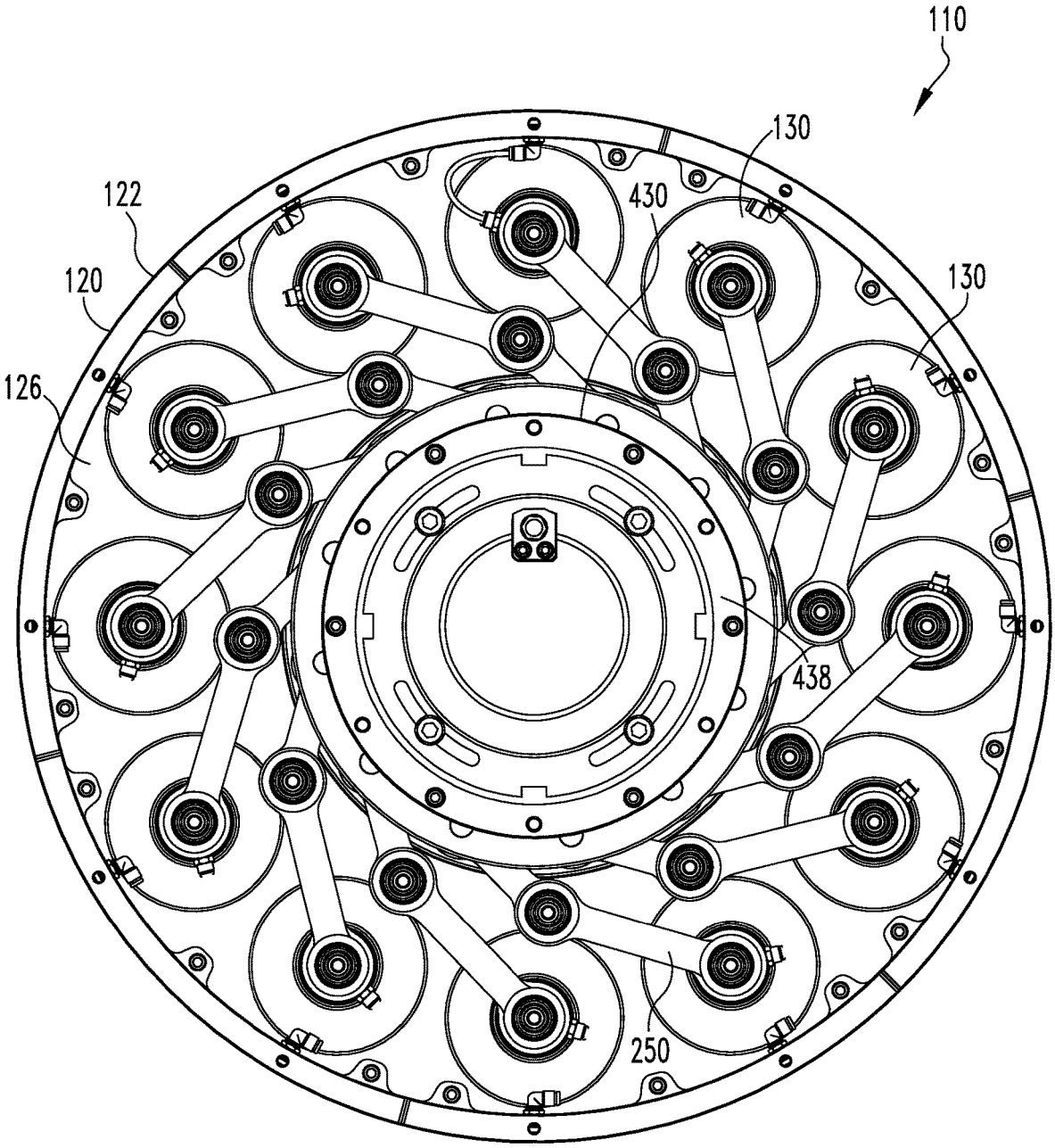
FIG. 9 is a back view of a base reformer assembly.
Figure 10:
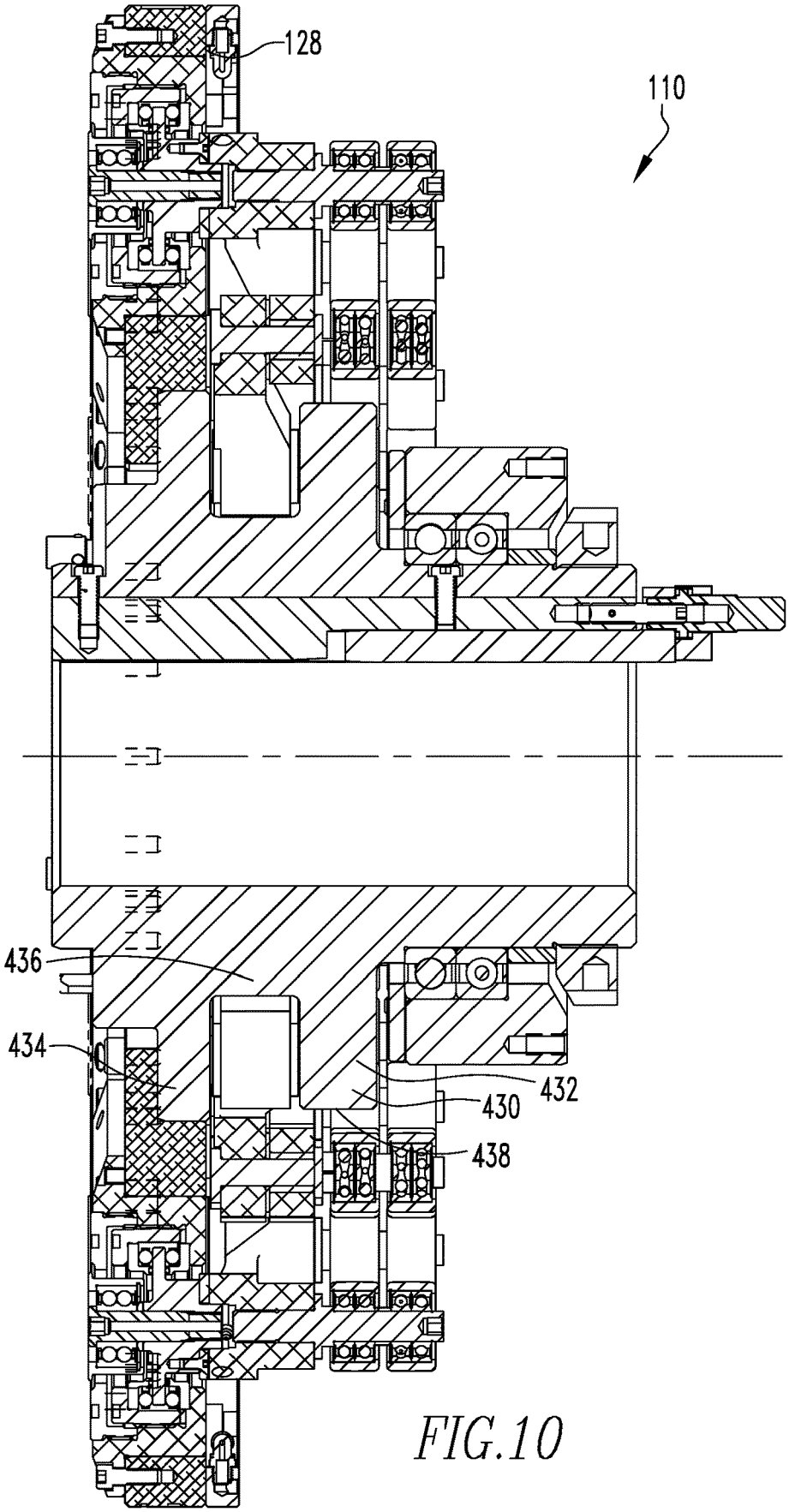
FIG. 10 is a cross-sectional side view of a base reformer assembly.

As shown in FIG. 5, the base reformer station 100 includes a housing assembly 102, a drive shaft 104, a can body support 106, a can body actuator assembly 108, and a base reformer assembly 110. The base reformer station housing assembly 102 is structured to be, and is, coupled, directly coupled, or fixed to the frame assembly 12. That is, the base reformer station housing assembly 102 is a fixed construct that does not generally move relative to the frame assembly 12. The base reformer station drive shaft 104 (also identified, and as used herein, as the "drive shaft" 104) is structured to be, and is, rotatably coupled to the base reformer station housing assembly 102. Thus, the base reformer station drive shaft 104 is structured to, and does, rotate relative to the base reformer station housing assembly 102. In an exemplary embodiment, the base reformer station drive shaft 104 includes an elongated, generally cylindrical body 105. The drive assembly 40 is structured to, and does, generate a rotational motion in the base reformer station drive shaft 104. The drive assembly 40 is operatively coupled to the base reformer station drive shaft 104 and causes the base reformer station drive shaft 104 to rotate about its longitudinal axis.

The base reformer station can body support 106 is structured to, and does, support a can body 1 as the can body moves through the base reformer station 100. Further, the base reformer station can body support 106 is structured to, and does, receive can bodies 1 from the transfer assembly 30. That is, the transfer assembly 30 transfers can bodies 1, one at a time, to the base reformer station can body support 106. The base reformer station can body support 106 is, in an exemplary embodiment, a non-vacuum starwheel 24 or a similar construct. The base reformer station can body support 106 is coupled, directly coupled, or fixed to the base reformer station drive shaft 104 and rotates therewith. In an exemplary embodiment, the can bodies 1 are received by the base reformer station can body support 106 and travel over an arc of about 272°. Further, in an exemplary embodiment, the base reformer station can body support 106 is generally circular and includes pockets for each can body 1.

The base reformer station can body actuator assembly 108 is structured to, and does, move the can bodies 1 axially on the base reformer station can body support 106. That is, the base reformer station can body actuator assembly 108 is structured to, and does, move the can bodies 1 from a received, first position on the base reformer station can body support 106 to a forming, second position wherein each can body 1 is positioned to be, and is, engaged and formed by the base reformer assembly 110. It is understood that the base reformer station can body support 106 is disposed opposite a base reformer assembly support plate 120, discussed below. Thus, in the first position, the can bodies 1 are spaced from the base reformer assembly support plate 120 and in the second position the can bodies 1 are disposed immediately adjacent the base reformer assembly support plate 120.

As shown in FIGS. 7-10, the base reformer station base reformer assembly 110, hereinafter the "base reformer assembly" 110, is structured to, and does, form the can body base 2 and, in an exemplary embodiment, the can body sidewall 3 adjacent the can body base 2. The base reformer assembly 110 includes a support plate 120, a number of base reformer roller die units 130 and a roller die actuating assembly 400. The base reformer assembly support plate 120 is, in an exemplary embodiment, a generally toroid, or disk-like, body 122. The base reformer assembly support plate body 122 has a forming/front, first side 124 and an operational/back, second side 126. Further, the base reformer assembly support plate body 122 defines a number of apertures 128 that each generally correspond to a base reformer assembly base reformer roller die unit 130. In an exemplary embodiment, the base reformer assembly support plate 120 supports twelve base reformer assembly base reformer roller die units 130. Thus, in this embodiment, there are twelve base reformer assembly support plate body apertures 128. The base reformer assembly support plate 120 also defines a number of passages, or mounting passages such as, but not limited to threaded bores, none numbered, to which other elements are coupled. Further, the base reformer assembly support plate 120 defines a number of fluid, or air, passages that are part of a can body ejection system 500, discussed below. The base reformer assembly support plate 120 is fixed to the base reformer station drive shaft 104 and rotates therewith. That is, in an exemplary embodiment, the base reformer assembly support plate 120 is coupled, directly coupled, or fixed to a roller die actuating assembly mounting plate 430, discussed below, which is fixed to the base reformer station drive shaft 104. As noted above, the base reformer assembly support plate 120 is disposed opposite the base reformer station can body support 106. That is, both the base reformer station can body support 106 and the base reformer assembly support plate 120 are fixed to the base reformer station drive shaft 104 and the base reformer assembly support plate first side 124 faces the base reformer station can body support 106.

Figure 11:
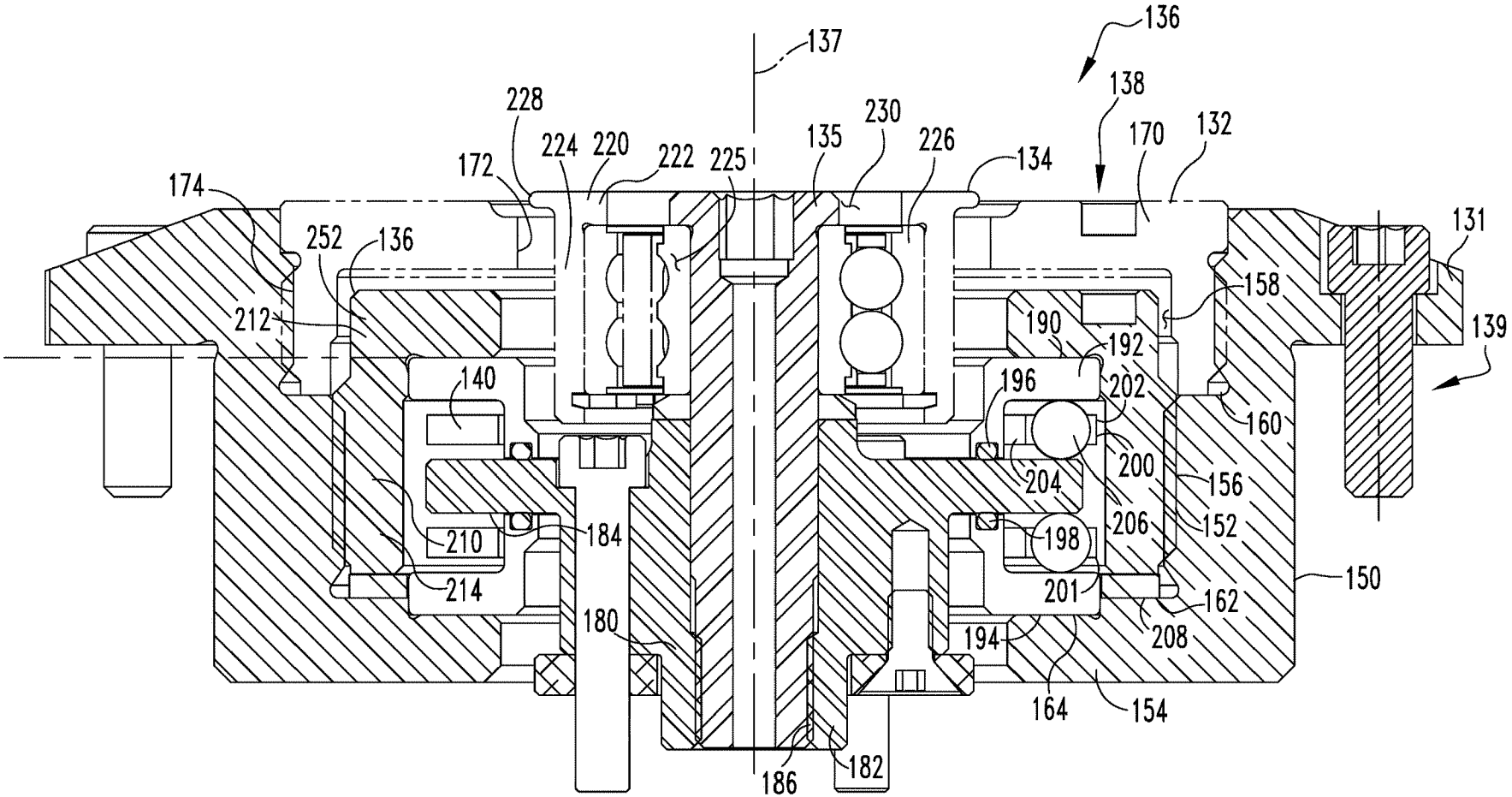
FIG. 11 is a cross-sectional side view of a base reformer roller die unit.
Figure 13:
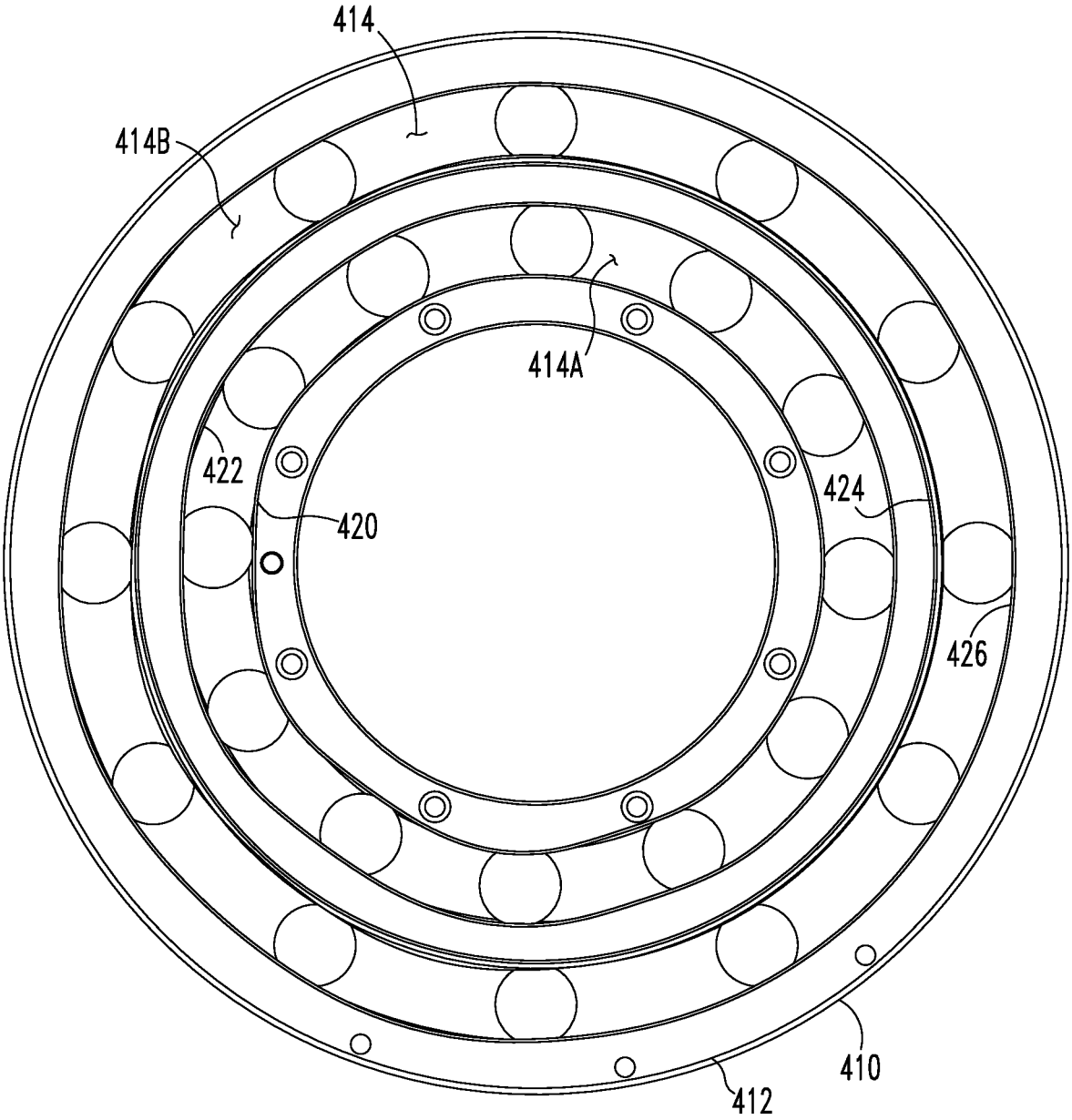
FIG. 13 is a back view of a cam plate.

As shown in FIG. 11, each base reformer roller die unit 130 is substantially similar and only one is described herein. The forming elements, i.e., the elements that form the can body 1, of the base reformer roller die unit 130 includes a generally toroid housing 131, a generally circular, or disk-like, chuck 132 and a roller die 134. As shown in FIG. 13, each base reformer roller die unit 130 further includes a roller die unit actuating assembly 250. Each roller die unit actuating assembly 250 is also considered to be part of the roller die actuating assembly 400 and will be described below. A base reformer roller die unit 130 further includes a leveling collar 136, a roller die friction reducing device 138 and a retaining collar 140.

The base reformer roller die unit housing 131 includes a generally toroid body 150. Thus, the base reformer unit housing body 150 defines a generally circular passage 152. In an exemplary embodiment, the base reformer unit housing body 150 includes a radially, inwardly extending flange 154 at the back side (the side away from the base reformer assembly support plate 120). Thus, the base reformer unit housing passage 152 at the base reformer unit housing flange 154 has a smaller radius than the rest of the base reformer unit housing passage 152. Further, in this configuration, an inner surface 156 of the base reformer unit housing body 150 defines a generally enclosed space 158. The base reformer unit housing body inner surface 156, in an exemplary embodiment, includes/defines a number of ledges 160, 162, 164 (three discussed below) wherein the radius of the reformer unit housing body passage 152 is reduced. It is noted that the back-most ledge 164 is defined by the base reformer unit housing flange 154. Further, while not discussed in detail, the base reformer unit housing body inner surface 156 defines threaded portions to which selected elements are coupled. Further, the base reformer unit housing body 150 defines coupling passages (not numbered) which, as shown, are disposed about the outer perimeter of the front side of the base reformer unit housing body 150. In an exemplary embodiment, a fastener is passed through each base reformer unit housing body 150 coupling passage and into a coupling, e.g., a threaded bore (not shown) on the base reformer assembly support plate 120.

Each base reformer unit chuck 132 (hereinafter and as used herein, a "chuck") also includes a generally toroid body 170. The chuck body 170 defines a forming surface 172 which is the inner radial surface of the chuck body 170. Further, the chuck body 170 includes an axially extending collar 174 having threads (not numbered) on the outer surface. It is understood that each different type of can body 1 has an associated base reformer unit chuck 132. That is, the base reformer unit chuck 132 is swapped out with another base reformer unit chuck 132 depending upon the type of can body 1 that is being processed.

Each base reformer unit leveling collar 136 also includes a generally toroid body 180. Each base reformer unit leveling collar body 180 includes a generally cylindrical portion 182 and a radially, outwardly extending flange 184. Each base reformer unit leveling collar body 180 defines a central passage 186. Each base reformer unit leveling collar body central passage 186 includes a threaded portion (not numbered). Further, the base reformer unit leveling collar body flange 184 defines a number of coupling passages (not numbered). The axis for each base reformer unit leveling collar body flange coupling passage extends generally parallel to the axis of the base reformer unit leveling collar body central passage 186.

Each base reformer unit roller die friction reducing device 138 includes a protective cover assembly 190 and a number of roller bearing assemblies 200, 201 (two shown). In an exemplary embodiment, each base reformer unit roller die friction reducing device protective cover assembly 190 includes two generally toroid covers 192, 194 and two seals 196, 198. Each of the base reformer unit roller die friction reducing device protective cover assembly covers 192, 194 have a generally L-shaped cross-section. Each base reformer unit roller die friction reducing device protective cover assembly seals 196, 198 are coupled to an associated base reformer unit roller die friction reducing device protective cover assembly cover 192, 194. The two base reformer unit roller die friction reducing device protective cover assembly covers 192, 194 are disposed as mirror images of each other. As described below, the two base reformer unit roller die friction reducing device protective cover assembly covers 192, 194 are spaced from each other. In this configuration, the base reformer unit roller die friction reducing device protective cover assembly covers 192, 194 define a partially enclosed space.

Each base reformer unit roller die friction reducing device roller bearing assemblies 200, 201 include two opposed races 202, 204 and a plurality of ball bearings 206. Each base reformer unit roller die friction reducing device roller bearing assembly race 202, 204 includes a toroid body (not numbered). Each two base reformer unit roller die friction reducing device roller bearing assembly race 202, 204 defines a track in which the ball bearings 206 are disposed. The assembly of the base reformer unit roller die friction reducing device 138 is discussed below.

Each base reformer unit retaining collar 140 includes a generally toroid body 210. Each base reformer unit retaining collar body 210 has a generally L-shaped cross-section defining a generally radially, inwardly extending retaining flange 212 and a generally axially extending coupling flange 214. In an exemplary embodiment, the outer surface of each base reformer unit retaining collar coupling flange 214 is threaded and is structured to be coupled to the base reformer unit housing body inner surface 156.

Each base reformer unit roller die 134 includes a generally toroid body 220. Each base reformer unit roller die body 220 has a generally L-shaped cross-section defining a generally radially extending flange 222 and a generally axially extending flange 224. The base reformer unit roller die body axially extending flange 224 is disposed at the outer perimeter of the base reformer unit roller die body radially extending flange 222. Thus, each base reformer unit roller die body 220 defines a generally enclosed space 225. Further, in an exemplary embodiment, each base reformer unit roller die 134 includes a bearing assembly 226. As shown, the base reformer unit roller die bearing assembly 226 is a common ball bearing assembly. Each base reformer unit roller die bearing assembly 226 is disposed in a base reformer unit roller die body enclosed space 225. Further, in an exemplary embodiment, the outer radial surface of the base reformer unit roller die body radially extending flange 222 is a forming surface 228. As shown, the outer radial surface of the base reformer unit roller die body radially extending flange forming surface 228 extends radially outwardly relative to the base reformer unit roller die body axially extending flange 224. Further, each base reformer unit roller die body 220 defines a recess 230 on the forward face, i.e., the side facing the base reformer station can body support 106. Each base reformer unit roller die body recess 230 is disposed about the passage formed by the base reformer unit roller die body 220.

Each base reformer roller die unit 130 is assembled as follows. Each of the base reformer unit roller die friction reducing device roller bearing assemblies 200, 201 are disposed on either side of the base reformer unit leveling collar body flange 184. A base reformer unit roller die friction reducing device protective cover assembly cover 192, 194 is then disposed over each base reformer unit roller die friction reducing device roller bearing assembly 200, 201 with the base reformer unit roller die friction reducing device protective cover assembly seals 196, 198 disposed adjacent, or immediately adjacent, the base reformer unit leveling collar body flange 184. The assembly of elements discussed above is disposed within the base reformer unit housing body enclosed space 158. An axial surface of the innermost base reformer unit roller die friction reducing device protective cover assembly cover 194 is disposed against base reformer unit housing body flange 154 with the outer radial surface abutting the innermost base reformer unit housing body inner surface ledge 164. In an exemplary embodiment, a spacer 208 is disposed on the axial surface of base reformer unit housing body inner surface ledge 164 prior to the insertion of the elements discussed above.

A base reformer unit retaining collar 140 is coupled, directly coupled, or fixed to the base reformer unit housing body 150. In an exemplary embodiment, as discussed above, the base reformer unit housing body inner surface 156 defines threaded portions and the outer surface of each base reformer unit retaining collar coupling flange 214 is threaded. The base reformer unit retaining collar 140 traps the base reformer unit leveling collar 136 and the base reformer unit roller die friction reducing device 138 in the base reformer unit housing body enclosed space 158. Moreover, in this configuration, the base reformer unit roller die friction reducing device roller bearing assemblies 200, 201 are substantially sealed. That is, the base reformer unit roller die friction reducing device 138 includes sealed friction reducing elements. This solves the problem(s) discussed above. That is, the base reformer unit roller die friction reducing device roller bearing assembly 200, 201 are not generally exposed to the atmosphere. Moreover, the most likely path of debris to enter the enclosed space containing the base reformer unit roller die friction reducing device roller bearing assemblies 200, 201 is sealed by the engagement of the base reformer unit roller die friction reducing device protective cover assembly seals 196, 198 and the base reformer unit leveling collar body flange 184. Further, in this configuration, each base reformer unit roller die friction reducing device 138 defines, or includes, a sealed thrust bearing 139.

It is further noted that the base reformer unit leveling collar body flange 184 has a smaller radial cross-sectional area than the space defined by the base reformer unit retaining collar 140. Thus, each base reformer unit leveling collar body 180 is structured to, and does, move relative to the base reformer unit retaining collar 140. Further, due to the base reformer unit roller die friction reducing device roller bearing assemblies 200, 201 disposed on either side of the base reformer unit leveling collar body flange 184, the base reformer unit leveling collar 136 is substantially prevented from twisting, or yawing/pitching relative to a central axis 137 (the axis extending through the center of the toroid body) of the base reformer unit leveling collar 136. Thus, the base reformer unit leveling collar body 180 is structured to, and does, move only substantially laterally relative to its own central axis. That is, the base reformer unit leveling collar body 180 is structured to, and does, move only in a plane extending generally perpendicular to the base reformer unit leveling collar body 180 central axis. Further, any element that is coupled, directly coupled, or fixed to the base reformer unit leveling collar body 180 will be limited to motion in a parallel plane.

A base reformer unit chuck 132 is then coupled, directly coupled, or fixed to the base reformer roller die unit housing 131. As noted above, and in an exemplary embodiment, the base reformer unit housing body inner surface 156 defines threaded portions and the chuck body axially extending collar 174 outer surface includes threads. The base reformer unit roller die 134 is then disposed within the base reformer unit chuck 132 and coupled to the base reformer unit leveling collar 136. In an exemplary embodiment, a fastener such as, but not limited to a retaining bolt 135 is passed through the central passages defined by the various toroidal elements 131, 150, 170, 180, 210, 220 and is coupled to the base reformer unit leveling collar body central passage 186 threaded portion. The base reformer unit roller die bearing assembly 226 is disposed between the retaining bolt 135 and the base reformer unit roller die body 220. Further, as the base reformer unit roller die 134 is coupled to the base reformer unit leveling collar body 180, the base reformer unit roller die 134 is structured to, and does, move only in a plane parallel to a plane extending generally perpendicular to the base reformer unit leveling collar body central axis 137. Further, the base reformer unit roller die body radially extending flange forming surface 228 is disposed generally opposite the chuck body forming surface 172.

Figure 12:
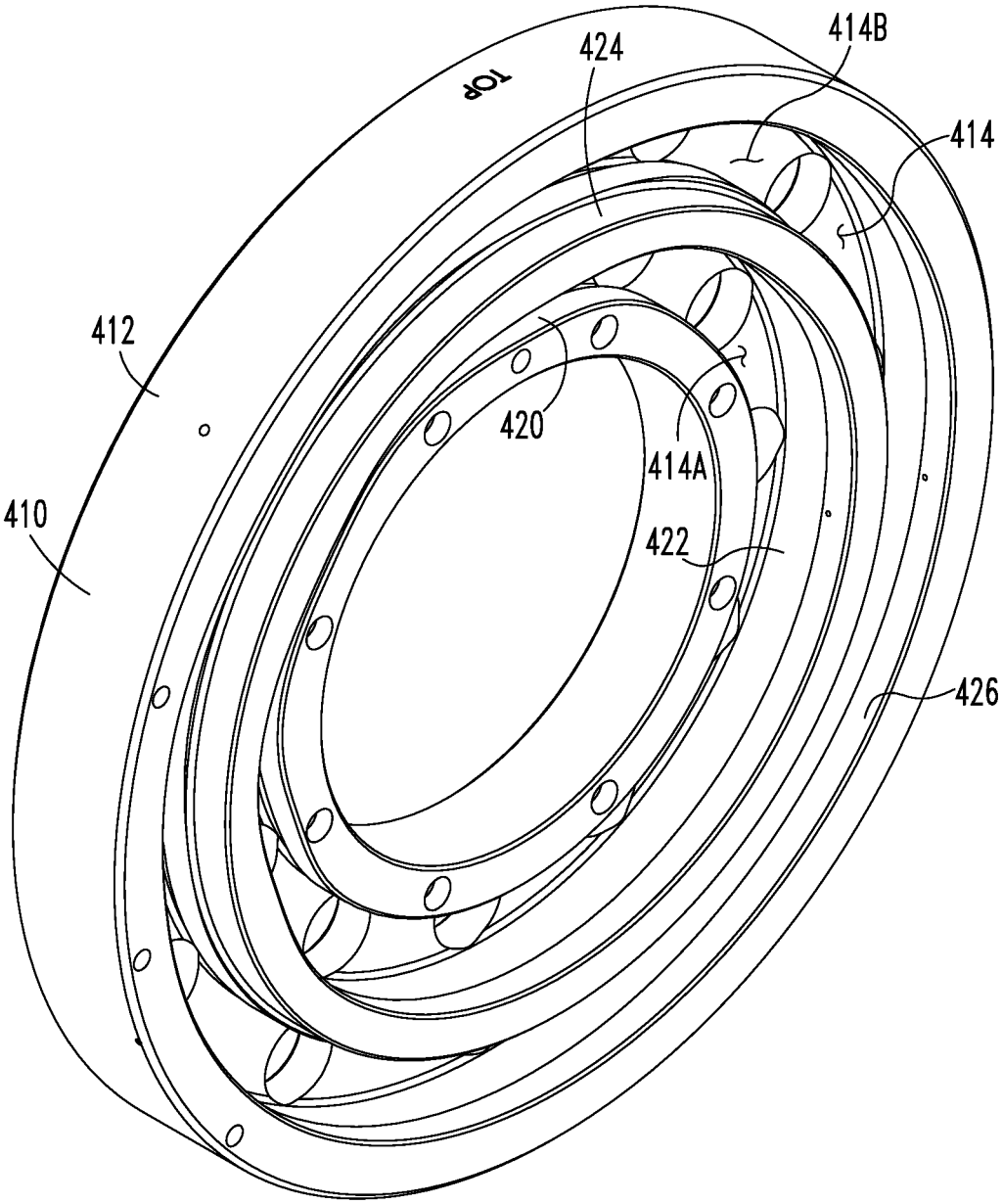
FIG. 12 is an isometric view of a cam plate.
Figure 14:
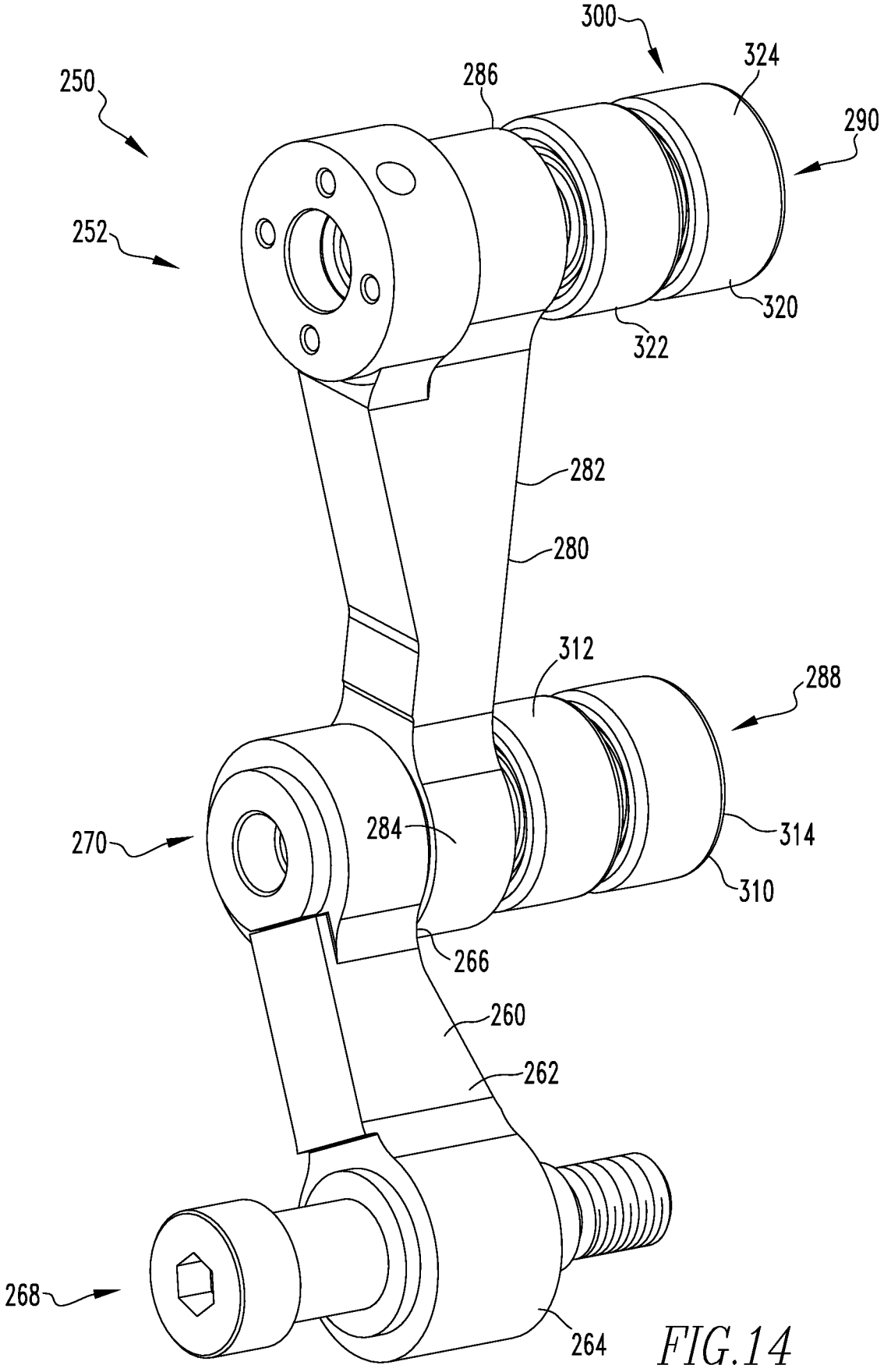
FIG. 14 is an isometric view of a roller die unit actuating assembly.

As noted above, each base reformer roller die unit 130 further includes a roller die unit actuating assembly 250. Each roller die unit actuating assembly 250 is also considered to be part of the roller die actuating assembly 400. The roller die actuating assembly 400 includes a cam plate 410, as shown in FIG. 12, a mounting plate 430, and the number of roller die unit actuating assemblies 250, as shown in FIG. 14. The roller die actuating assembly cam plate 410, hereinafter, and as used herein, "cam plate" 410, includes a generally planar, toroid body 412 that defines a number of cam channels 414. In another exemplary embodiment, the cam plate body 412 is generally circular or disk-like. Further, in an exemplary embodiment, there are two cam channels, a first cam channel 414A and a second cam channel 414B. The two cam channels 414A, 414B are cooperative cam channels. In one embodiment, the two cam channels 414A, 414B are one of circular cooperative cam channels or spiral/circular cooperative cam channels. Alternatively, the two cam channels 414A, 414B are triple spiral/circular cooperative cam channels. In an exemplary embodiment, the first cam channel 414A is a dual-level cam channel including a first cam surface 420 at a first elevation and a second cam surface 422 at a second elevation. Similarly, the second cam channel 414B is a dual-level cam channel including a first cam surface 424 at a first elevation and a second cam surface 426 at a second elevation.

Further, the two cam channels 414A, 414B are each generally circular and are both disposed about the drive shaft 104. That is, the cam plate 410 is coupled, directly coupled, or fixed to the base reformer station housing assembly 102 with the drive shaft 104 extending through the cam plate 410. Further, the cam plate 410 is oriented with the two cam channels 414A, 414B facing the base reformer station can body support 106.

The roller die actuating assembly mounting plate 430 (FIGS. 9 and 10), hereinafter and as used herein, "mounting plate" 430 is structured to, and does, pivotally, or rotatably, support each roller die unit actuating assembly 250. That is, each roller die unit actuating assembly 250 is pivotally, or rotatably, coupled to the mounting plate 430. The mounting plate 430 is coupled, directly coupled, or fixed to the base reformer station drive shaft 104 and rotates therewith. That is, both the base reformer station drive shaft 104 and the mounting plate 430 define an axially extending keyway (not numbered), i.e., a channel or groove. A rigid key (not numbered) is disposed in the two keyways thereby fixing the mounting plate 430 to the base reformer station drive shaft 104. In an exemplary embodiment, the mounting plate 430 includes a body 432 having a generally planar and toroid first member 434, a generally planar and toroid second member 436, and a generally planar and toroid third member 438. As shown, the mounting plate body 432 is a unitary body and, as such, the mounting plate body first, second, and third members 434, 436, 438 are also identified herein as "portions."

The mounting plate first and third members 434, 438 have, in an exemplary embodiment, about the same outer radius. The mounting plate second member 436 has a smaller radius than the mounting plate first and third members 434, 438. The inner radius for each mounting plate member 434, 436, 438 is generally, or substantially, the same as the base reformer station drive shaft 104. The mounting plate second member 436 is disposed between the mounting plate first and third members 434, 438. In an exemplary embodiment, and when assembled, the mounting plate first member 434 is structured to be, and is, disposed generally in the same plane as the base reformer assembly support plate 120. That is, the mounting plate first member 434 is structured to, and does, fit within the central opening of the toroid base reformer assembly support plate body 122. The mounting plate third member 438 is structured to be, and is, disposed generally in the same plane as the cam plate body 412. That is, the mounting plate third member 438 is structured to, and does, fit within the central opening of the toroid base reformer assembly cam plate body 412. In an exemplary embodiment, the roller die unit actuating assemblies 250 are pivotally, or rotatably, coupled to the mounting plate third member 438.

The two cam channels 414A, 414B, described above, are operatively coupled to each roller die unit actuating assembly 250. Each roller die unit actuating assembly is substantially similar and only one is described herein. Each roller die unit actuating assembly 250 includes a parallel linkage 252 which is an assembly including a proximal, first link member 260, a distal, second link member 280, a cam follower assembly 300, and a number of coupling components/pivot pins (not numbered).

Each first link member 260 includes an elongated body 262 with a first end 264 and a second end 266. Each of the first link member body first and second ends 264, 266 defines a pivot coupling 268, 270. In an exemplary embodiment, the first link member body first and second end pivot coupling 268, 270 is a passage (not numbered) with a generally circular cross-section. Similarly, each second link member 280 includes an elongated body 282 with a first end 284 and a second end 286. Each of the second link member body first and second ends 284, 286 defines a pivot coupling 288, 290. Further, the second link member body second end 286 defines a number of threaded bore holes (not numbered). In an exemplary embodiment, the first link member body first and second end pivot coupling 268, 270 is a passage (not numbered) with a generally circular cross-section. Thus, the first link member body first end 264 is structured to be pivotably, or rotatably, coupled to the mounting plate 430 (or in an alternate embodiment, to the base reformer assembly support plate 120), the first link member body second end 266 is structured to be pivotably coupled to the second link member body first end 284, (and conversely, the second link member body first end 284 is structured to be, and is, pivotably coupled to the first link member body second end 266), the second link member body second end 286 is structured to be rotatably coupled to a roller die 134.

The cam follower assembly 300 includes a first cam follower 310 and a second cam follower 320. In an exemplary embodiment, the first cam follower 310 includes a first roller 312 and a second roller 314. As used herein, a cam "roller" means a wheel or similar generally circular/cylindrical construct. Further, the first cam follower first roller 312 and the first cam follower second roller 314 are rotatably disposed on the same axis of rotation. Similarly, the second cam follower 320 includes a first roller 322 and a second roller 324 that are rotatably disposed on the same axis of rotation.

Each roller die unit actuating assembly 250 is assembled as follows. Each first link member 260 is pivotally coupled to the mounting plate 430 (or to the base reformer assembly support plate second side 126) adjacent the center passage of the mounting plate 430. That is, each first link member body first end 264 is pivotably coupled to the mounting plate 430. Each first link member body second end 266 is pivotably coupled to an associated second link member body first end 284. Each first cam follower 310 is rotatably coupled to a second link member body first end 284. It is understood that the axis of rotation of the first cam follower first roller 312 and the first cam follower second roller 314 is the same as the axis of rotation defined by the pivot coupling at the second link member body first end 284. A second cam follower first roller 322 and a second cam follower second roller 324 are rotatably coupled to a second link member body second end 286. The axis of rotation for each second cam follower first roller 322 and a second cam follower second roller 324 is substantially parallel to the axis of rotation of the first cam follower first rollers 312 and the first cam follower second rollers 314.

The second link member body second end 286 is further coupled, directly coupled, or fixed to the base reformer roller die unit 130. That is, (when the base reformer unit roller die 134 is not installed) fasteners (not numbered) are passed through the base reformer unit leveling collar body flange 184 coupling passages and into the second link member body second end 286 threaded bores.

The roller die actuating assembly 400 is assembled as follows. The base reformer assembly support plate 120 (which supports the base reformer roller die units 130) is positioned on the drive shaft 104. The mounting plate 430 is positioned on the drive shaft 104 and moved axially thereon until each base reformer roller die unit 130 is disposed in a base reformer assembly support plate body aperture 128. In this configuration, the first and second cam followers 310, 320 are disposed adjacent, i.e., on the side of the roller die unit actuating assembly 250 that faces, the cam plate 410. The base reformer assembly support plate 120 and the mounting plate 430 are then moved axially on the base reformer station drive shaft 104 until the first and second cam followers 310, 320 are disposed in the first and second cam channels 414A, 414B, respectively.

That is, the base reformer assembly support plate 120 and the mounting plate 430 are moved toward the cam plate 410 so that the first cam follower 310 is disposed in the first cam channel 414A and the second cam follower 320 is disposed in the second cam channel 414B. It is understood that in this configuration, the first cam channel first cam surface 420 is structured to be, and is, operatively coupled to the first cam follower first roller 312. Similarly, the first cam channel second cam surface 422 is structured to be, and is, operatively coupled to the first cam follower second roller 314; the second cam channel first cam surface 424 is structured to be, and is, operatively coupled to the second cam follower first roller 322; the second cam channel second cam surface 426 is structured to be, and is, operatively coupled to the second cam follower second roller 324.

Thus, as the base reformer assembly support plate 120 and the mounting plate 430 rotate with the drive shaft 104, each cam follower 310, 320 is moved through the associated cam channel 414A, 414B and is selectively engaged by the associated cam surface(s) 420, 422, 424, 426. That is, the selective engagement moves each cam follower 310, 320 in a desired pattern. As noted above, the two cam channels 414A, 414B are cooperative cam channels. Thus, the selective engagement moves each cam follower 310, 320 and the parallel linkage 252 so as to create a desired motion in an "actuated element." In an exemplary embodiment, the second link member body second end 286 is the "actuated element" which moves over a desired path. Further, because the roller die 134 is coupled to the second link member body second end 286, the roller die 134 also moves over the selected path. As further noted above, in one embodiment, the cam channels 414A, 414B are triple spiral/circular cooperative cam channels. In this embodiment, each roller die 134 moves over a path including two generally circular forming paths and one generally circular ironing path. Further, in an exemplary embodiment, the path over which the roller die 134 spirals in/out extends over a curve extending between about 0° and about 90°. In this exemplary embodiment, the roller die 134 initially engages the can body base 2 at about 50° and applies a full bias/force to form the can body base 2 at 90°. That is, while the roller die 134 applies a bias/force sufficient to form the can body base 2 prior to traveling over a 90° arc, the full depth of penetration, i.e., the roller die 134 is at the maximum radius, occurs as the roller die 134 travels over an arc of about 90°.

Figure 15A:
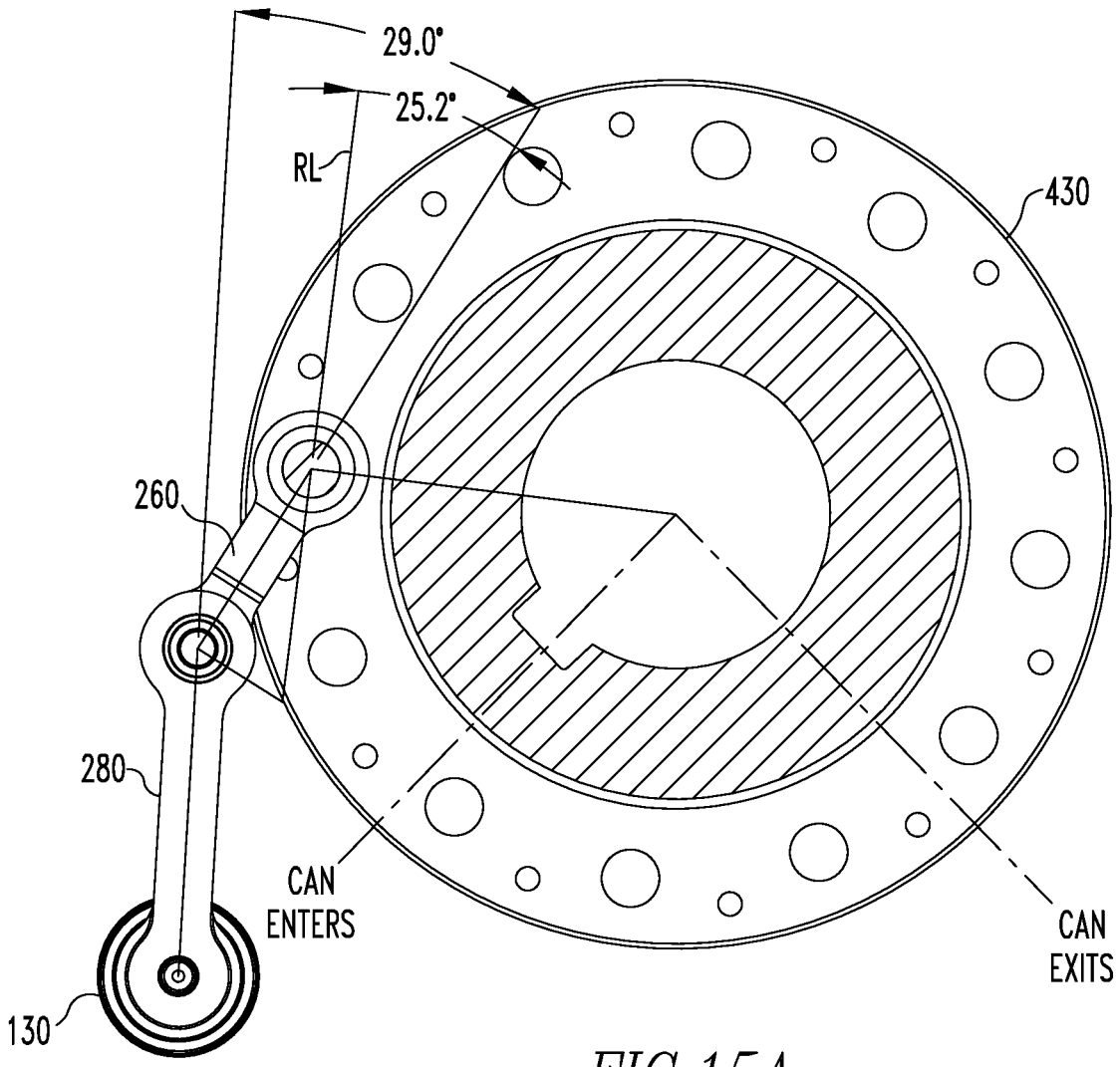
FIGS. 15A-15F are schematic axial views showing the relative motion of a roller die unit actuating assembly elements.
Figure 15B:
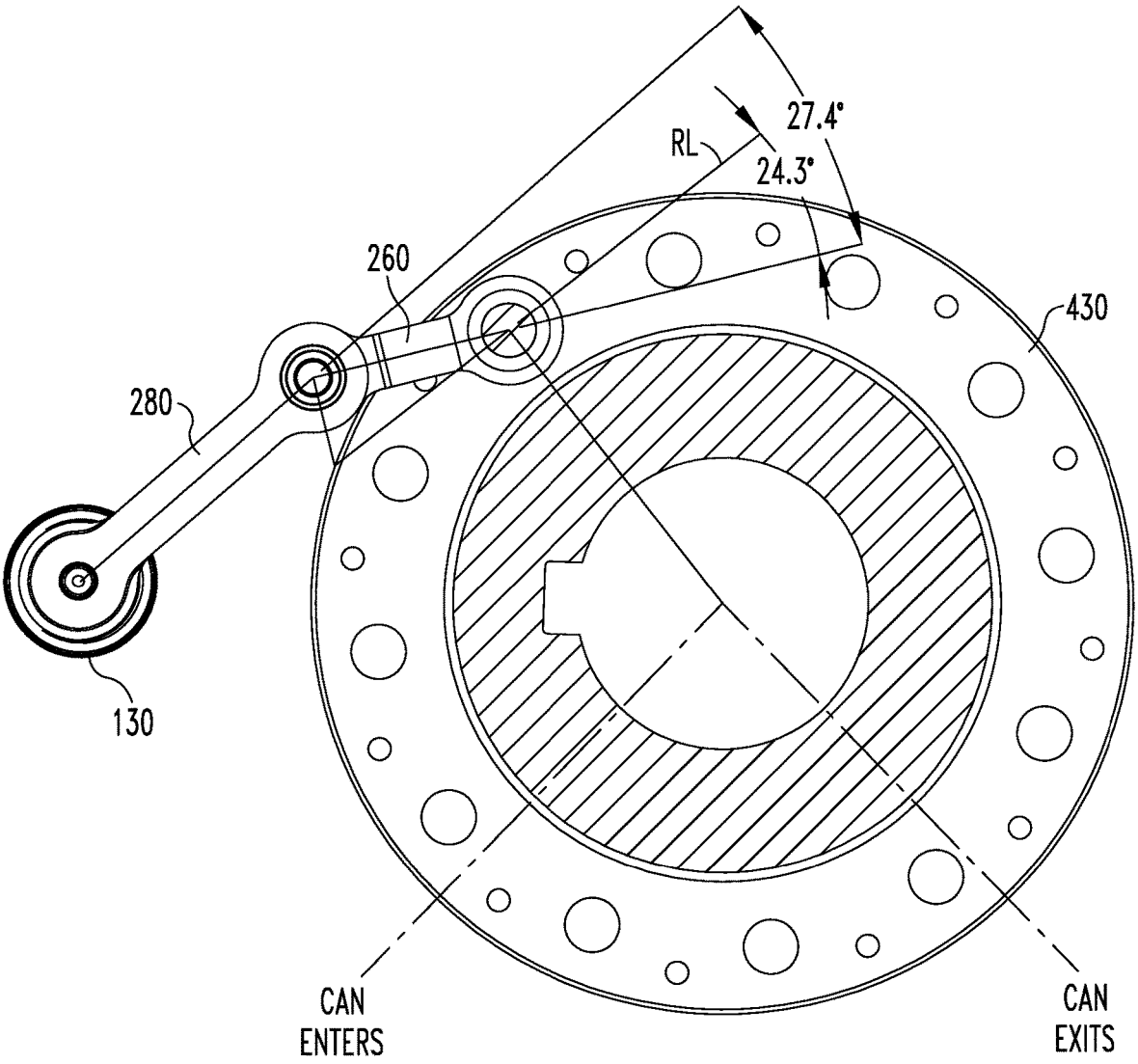
Figure 15C:
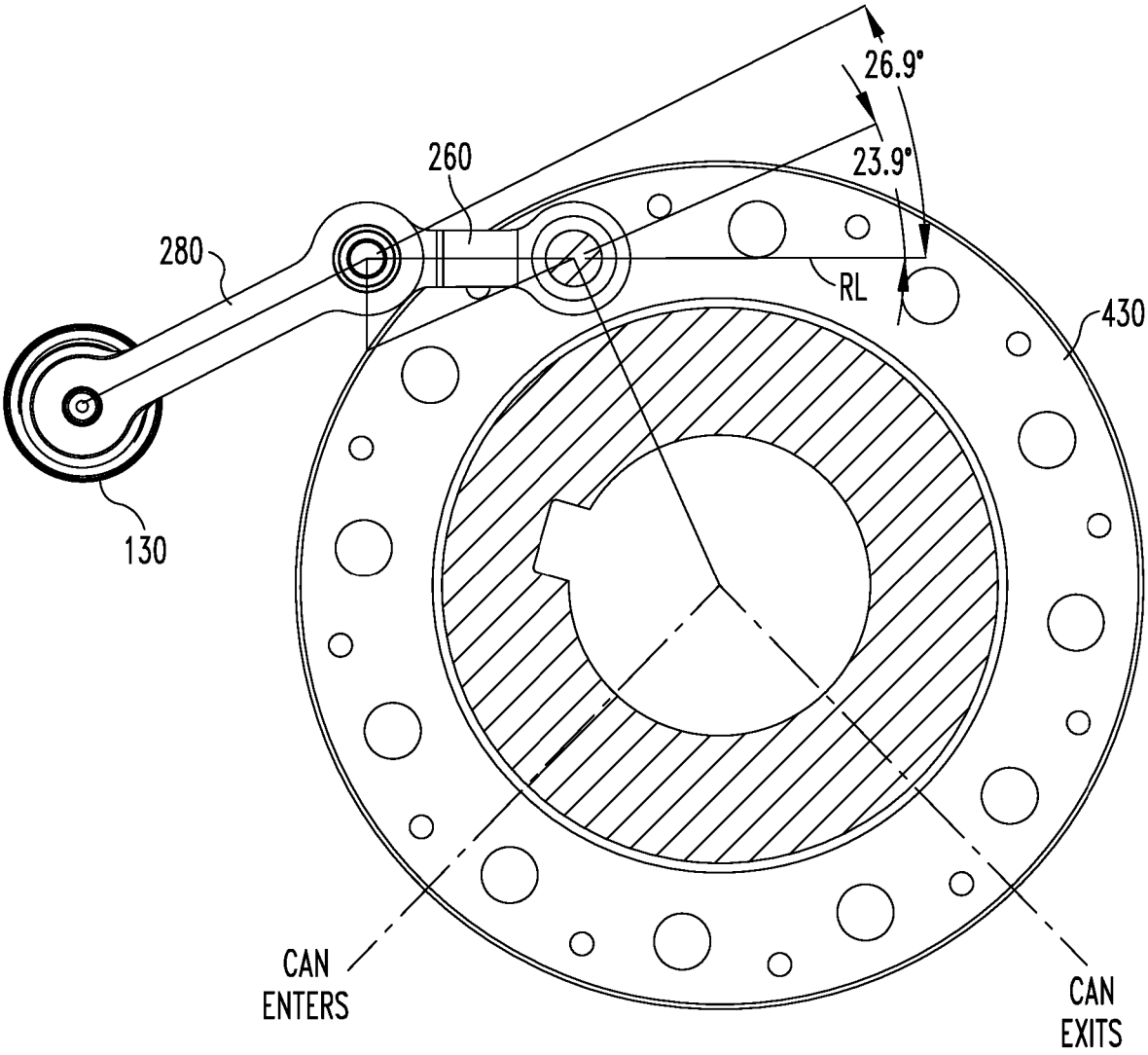
Figure 15D:
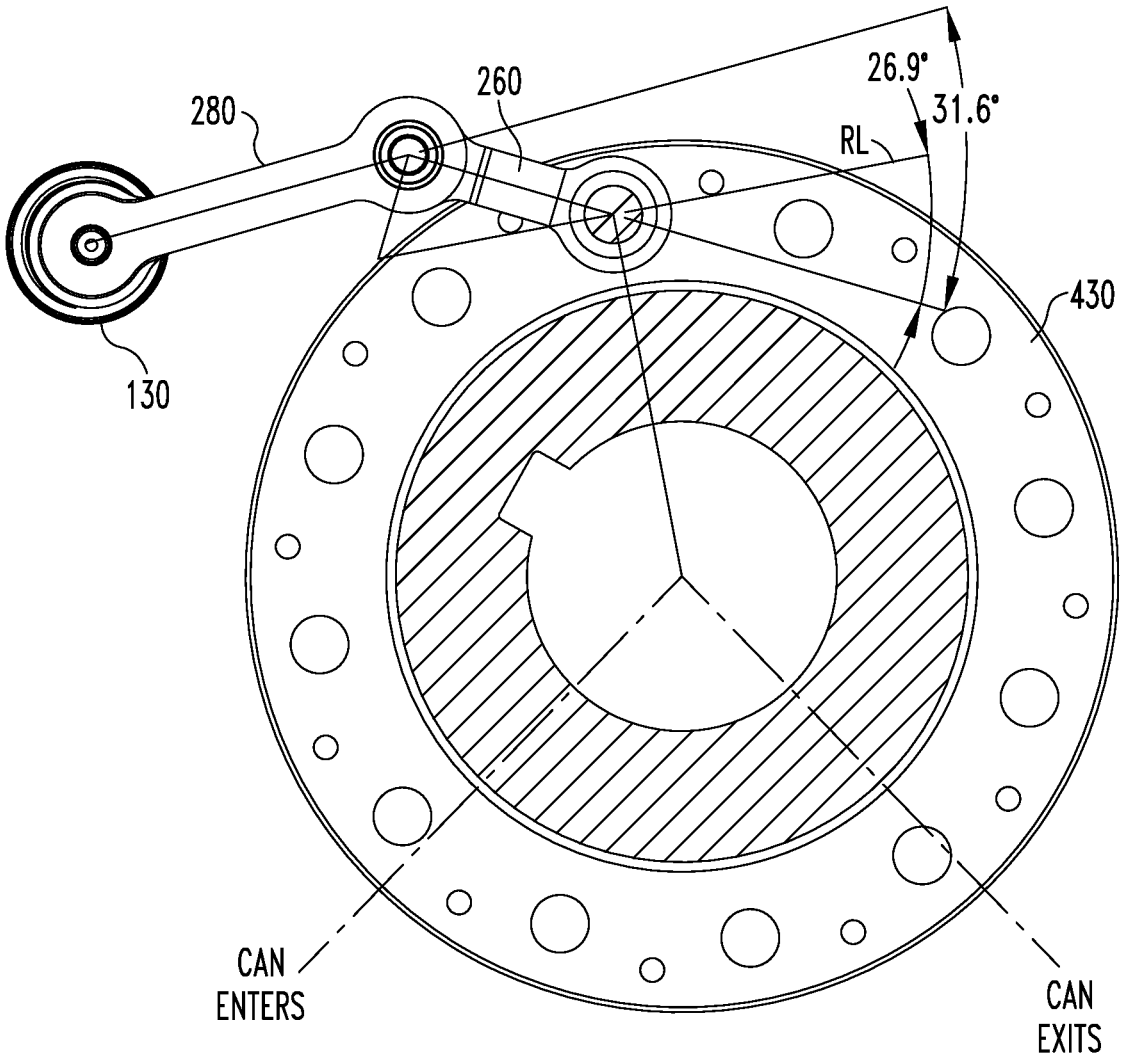
Figure 15E:
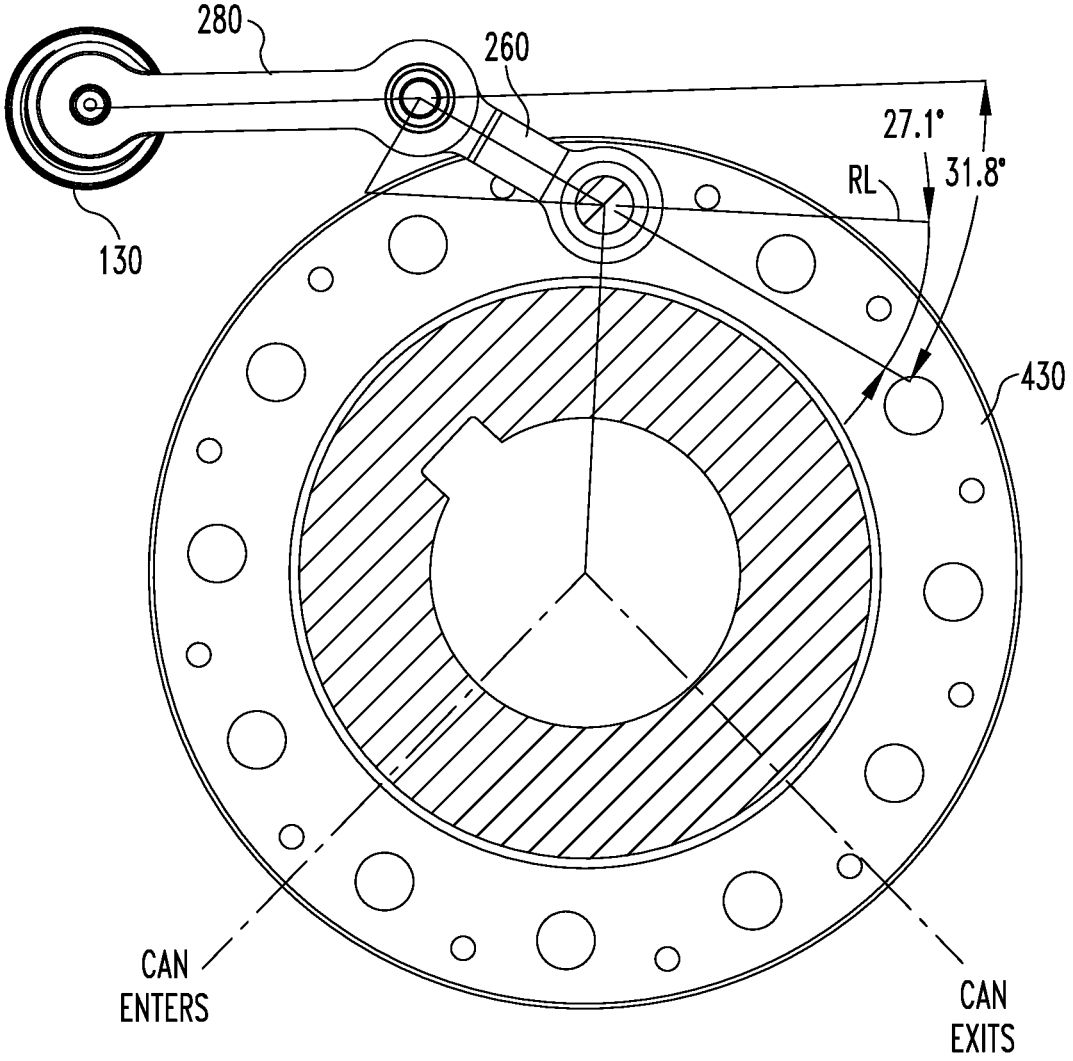
Figure 15F:
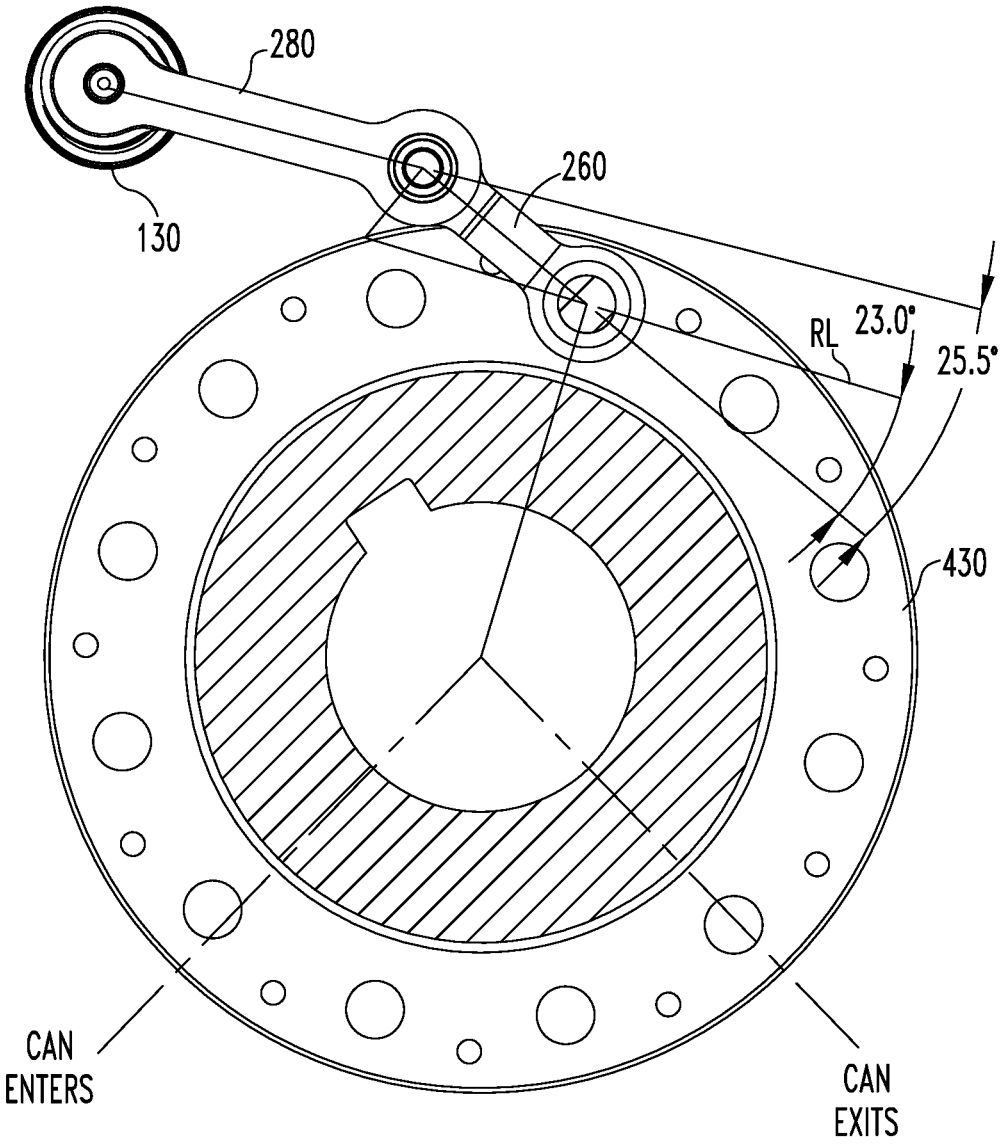
Figure 16:
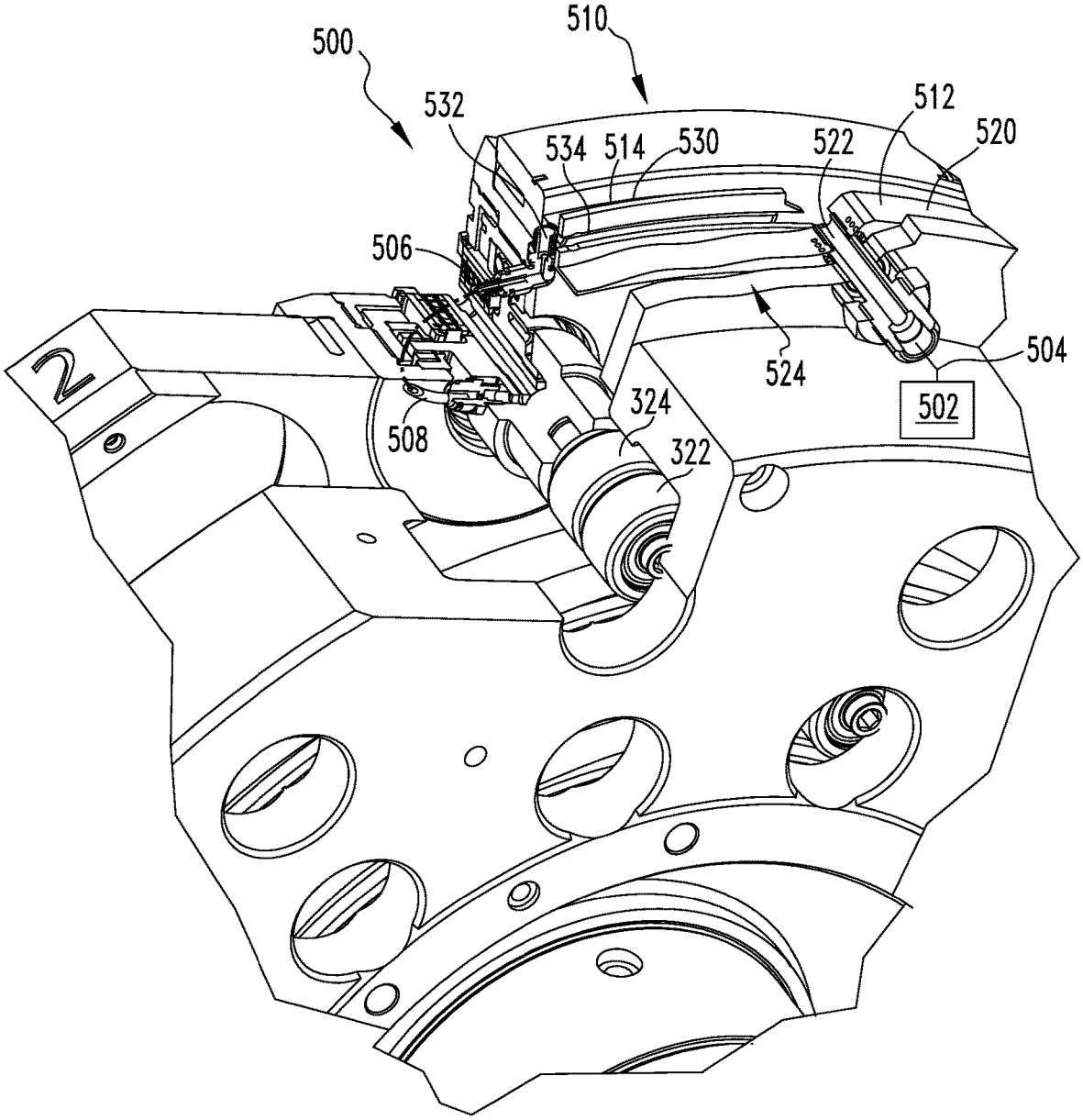
FIG. 16 is a partial cross-sectional isometric view of a can body ejection system.

An exemplary illustration of the movement of a roller die unit actuating assembly 250 is shown in FIGS. 15A-15F. That is, FIGS. 15A-15F show how the cam channels 414A, 414B cause the roller die unit actuating assembly first link member 260 and the roller die unit actuating assembly second link member 280 to move relative to each other as the base reformer assembly support plate 120 and the mounting plate 430 rotate with the drive shaft 104. For clarity, FIGS. 15A-15F show only the mounting plate 430. The angle of the longitudinal axis of the roller die unit actuating assembly first link member 260 is measured relative to a reference line (RL) extending generally, or substantially, perpendicular to a line extending radially from the drive shaft 104. The angle of the longitudinal axis of the roller die unit actuating assembly second link member 280 is measured relative to the longitudinal axis of the roller die unit actuating assembly first link member 260. FIG. 15A shows the positions of the roller die unit actuating assembly first link member 260 and the roller die unit actuating assembly second link member 280 as a can body 1 is disposed on a base reformer roller die unit 130. FIG. 15B shows the positions of the roller die unit actuating assembly first link member 260 and the roller die unit actuating assembly second link member 280 as a base reformer unit roller die 134 initially engages the can body. FIGS. 15C-15F show the position of the roller die unit actuating assembly first link member 260 and the roller die unit actuating assembly second link member 280 as a base reformer unit roller die 134 moves over 90°, 180°, 270° and 360° of the can body base 2, respectively. As described below, but not shown in FIGS. 15A-15F, the base reformer unit roller die 134 further forms the can body base 2 as the base reformer assembly support plate 120 and the mounting plate 430 continue to rotate with the drive shaft 104.

That is, a can body 1 moves through the necker machine 10 until the transfer assembly 30 feeds the can body 1 to the base reformer station 100 and, more specifically, to the can body support 106. Once there, the can body 1 is moved by the can body actuator assembly 108 until the can body base 2 is disposed in a base reformer roller die unit 130. That is, the can body base 2 is disposed between chuck body forming surface 172 and base reformer unit roller die body radially extending flange forming surface 228.

As the base reformer station can body support 106 rotates with the drive shaft 104, the roller die actuating assembly 400 actuates the base reformer unit roller die 134. That is, as described above, the moving base reformer station can body support 106 causes the first cam follower 310 and the second cam follower 320 to move through the stationary cam channels 414A, 414B. This, in turn, causes the actuated element, i.e., the second link member body second end 286 to move over a selected path. The base reformer unit roller die 134 is coupled to the second link member body second end 286 and moves therewith. Thus, the base reformer unit roller die 134 is also an actuated element and also moves over the selected path. In an exemplary embodiment, the cam channels 414A, 414B are triple spiral/circular cooperative cam channels. Thus, the base reformer unit roller die 134 is initially disposed at an origin which is generally centered in the domed can body base 2. That is, in this position, the base reformer unit roller die 134 is generally spaced from the base reformer unit chuck 132. As the base reformer unit roller die 134 is actuated, it spirals outwardly until base reformer unit roller die body radially extending flange forming surface 228 engages the inner radial surface of the can body base 2. Simultaneously, the chuck body forming surface 172 engages the outer radial surface of the can body base 2. The base reformer unit roller die 134 then moves in a circular pattern three times. During the first two revolutions of the base reformer unit roller die 134, the base reformer unit roller die 134 forms the can body base 2. On the last revolution, the base reformer unit roller die 134 irons the can body base 2. The can body base 2 then spirals inwardly until the base reformer unit roller die 134 returns to the origin. At this point, the can body base 2 is reformed and the can body 1 is passed to the transfer assembly 30 to be moved to another processing station 20.

It is noted that in this configuration, each roller die unit actuating assembly 250 is actuated exclusively by the cam follower assembly 300. Thus, each roller die unit actuating assembly 250 is a cam actuated actuating assembly. Further, in this configuration, the cam actuated actuating assembly, and thus each base reformer roller die unit 130 as well as each base reformer assembly 110, does not include any gears. Moreover, because the elements of the cam actuated actuating assembly, and each base reformer roller die unit 130 as well as each base reformer assembly 110, are relatively large compared to, for example gear teeth, all elements of the roller die unit actuating assembly 250 have a robust cross-sectional area. Thus, the base reformer roller die units 130, as described above, solve the problem(s) noted above.

It is noted that in this configuration, the base reformer unit roller die body 220 has a larger diameter relative to the roller dies of the prior art. Thus, the base reformer unit roller die body 220 has the potential to contact or engage the can body 1 at the point where the can body 1 is being moved from a base reformer roller die unit 130 to the transfer assembly 30. To overcome this potential problem, the base reformer station 100 further includes a can body ejection system 500, as shown in FIG. 14. In an exemplary embodiment, the can body ejection system 500 includes a pressurized fluid supply 502, a conduit assembly 504 and a number of ejection nozzles 506. The pressurized fluid supply 502 is structured to, and does, provide a supply of pressurized air or other gas(es). The pressurized fluid supply 502 is in fluid communication with the conduit assembly 504; thus, pressurized gas moves through the conduit assembly 504. Each ejection nozzle 506 is in fluid communication with the conduit assembly 504. Further, each ejection nozzle 506 is, in an exemplary embodiment, disposed at each base reformer unit roller die 134 and/or base reformer assembly base reformer roller die unit 130.

That is, in an exemplary embodiment, the can body ejection system conduit assembly 504 includes a manifold assembly 510. The can body ejection system conduit assembly manifold assembly 510, hereinafter "manifold assembly" 510, includes a fixed manifold 512 and a rotating manifold 514. The fixed manifold 512 includes a generally toroid body 520 with a generally rectangular cross-section and having a number of inlet ports 522. The front face of the fixed manifold body 520 (the surface closest to the base reformer station can body support 106) defines a groove 524 that extends over the front axial face of the fixed manifold body 520. That is, the fixed manifold body groove 524 is generally circular. The rotating manifold 514 also includes a generally toroid body 530 with a generally rectangular cross-section and a number of outlet ports 532. The rotating manifold body 530 also includes a groove 534. The rotating manifold body groove 534 is disposed on the rear axial face (the surface farthest from the base reformer station can body support 106) of the rotating manifold body 530. The rotating manifold body outlet ports 532 are disposed generally evenly about the rotating manifold body 530 with one rotating manifold body outlet port 532 for each base reformer assembly base reformer roller die unit 130. Each rotating manifold body outlet port 532 is in fluid communication with the rotating manifold body groove 534. The fixed manifold body 520 and the rotating manifold body 530 have generally similar inner and outer radii. Further, the fixed manifold body groove 524 and the rotating manifold body groove 534 have substantially the same radius.

The can body ejection system conduit assembly 504 further includes conduits such as, but not limited to, hoses 508. Further, in this embodiment, the base reformer unit leveling collar 136 and the retaining bolt 135 both define passages (186 and not numbered, respectively). In an exemplary embodiment, the base reformer unit leveling collar 136 passage is a radially extending passage and the retaining bolt 135 passage is an axially extending passage.

A hose 508 extends between the rotating manifold body 530. That is, the rotating manifold body 530 is in fluid communication with each hose 508. Each hose 508 is in fluid communication with a base reformer unit leveling collar passage 186. Each base reformer unit leveling collar passage 186 is in fluid communication with a retaining bolt 135 passage. Each retaining bolt 135 passage defines an ejection nozzle 506. That is, each retaining bolt 135 passage extends through the retaining bolt 135 and is open on the front side thereof.

The can body ejection system 500 is assembled as follows. The fixed manifold 512 is coupled, directly coupled, or fixed to the base reformer station housing assembly 102 adjacent the base reformer assembly support plate 120. In an exemplary embodiment, the fixed manifold 512 is coupled, directly coupled, or fixed to the cam plate 410. The rotating manifold 514 is coupled, directly coupled, or fixed to the base reformer assembly support plate 120. Further, the back surface of the rotating manifold 514 abuts the front surface of the fixed manifold 512 and the fixed manifold body groove 524 and the rotating manifold body groove 534 are aligned thereby forming a conduit (not numbered). As is known, a seal, or similar construct, is disposed between the fixed manifold 512 and the rotating manifold 514 if needed. The can body ejection system pressurized fluid supply 502 is in fluid communication with the fixed manifold 512 and, more specifically, with the fixed manifold body groove 524 and the conduit defined thereby. The rotating manifold 514 is in selective fluid communication with the fixed manifold 512. That is, the rotating manifold body groove 534 has an adjustable length so that the ejection of the can bodies 1 coincide with the timing requirements of the base reformer station 100. As noted above, the rotating manifold 514 is in fluid communication with each hose 508. Each hose 508 is in fluid communication with an associated ejection nozzle 506.

In this configuration, the pressurized fluid supply 502 is in fluid communication with each ejection nozzle 506. Thus, the can body ejection system 500 supplies positive pressure to each can body base 2 following the forming of the can body base 2. That is, the can body ejection system 500 assists the transfer of each can body from the base reformer station base reformer assembly 110 to the transfer assembly 30. This solves the problem(s) noted above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A base reformer roller die unit for a necker machine base reformer comprising:

a toroid chuck;

a roller die;

said roller die movably disposed within said chuck;

a roller die unit actuating assembly structured to actuate said roller die;

said roller die unit actuating assembly operatively coupled to said roller die; and wherein all elements of the roller die unit actuating assembly have a robust cross-sectional area, wherein said roller die unit actuating assembly includes a parallel linkage, wherein:

said parallel linkage includes a proximal, first link member and a distal, second link member;

said first link member including a body with a first end and a second end;

each of said first link member body first end and said first link member body second end defining a pivot coupling, said second link member including a body with a first end and a second end;

each of said second link member body first end and said second link member body second end defining a pivot coupling;

said first link member body first end structured to be pivotably coupled to a base reformer assembly support plate;

said first link member body second end structured to be pivotably coupled to said second link member body first end;

said second link member body first end structured to be pivotably coupled to said first link member body second end; and said second link member body second end structured to be rotatably coupled to said roller die.

2. The base reformer roller die unit of claim 1 wherein said roller die unit actuating assembly does not include any gears.

3. The base reformer roller die unit of claim 1 wherein said roller die unit actuating assembly is a cam actuated actuating assembly.

4. The base reformer roller die unit of claim 1 wherein:

said roller die unit actuating assembly includes a roller die friction reducing device; and wherein said friction reducing device includes sealed friction reducing elements.

5. The base reformer roller die unit of claim 4 wherein said friction reducing device includes a sealed thrust bearing.

* * * * *